US007108965B2

(12) United States Patent
Mori et al.

(10) Patent No.: US 7,108,965 B2
(45) **Date of Patent: *Sep. 19, 2006**

(54) PHOTOTHERMOGRAPHIC MATERIAL AND IMAGE FORMING METHOD USING THE SAME

(75) Inventors: Takayoshi Mori, Kanagawa (JP); Kazutaka Takahashi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/222,744

(22) Filed: Sep. 12, 2005

(65) Prior Publication Data

US 2006/0057515 A1 Mar. 16, 2006

(30) Foreign Application Priority Data

Sep. 15, 2004 (JP) ..... 2004-268560

(51) Int. Cl.
*G03C 1/00* (2006.01)

(52) U.S. Cl. ..... 430/617; 430/618; 430/619; 430/620; 430/964

(58) Field of Classification Search ..... 430/617–620, 430/964

See application file for complete search history.

(56) References Cited

U.S. PATENT DOCUMENTS

| | | | |
|---|---|---|---|
| 6,630,291 | B1 | 10/2003 | Maskasky et al. |
| 6,713,241 | B1 | 3/2004 | Vaeth et al. |
| 2004/0053173 | A1 | 3/2004 | Maskasky et al. |

*Primary Examiner*—Geraldine Letscher

(74) *Attorney, Agent, or Firm*—Margaret A. Burke; Sheldon J. Moss

(57) ABSTRACT

A photothermographic material for blue light exposure that has a good coating surface condition and an image forming method for use with the photothermographic material are provided. The photothermographic material includes a support, and an image forming layer provided on at least one side of the support. The image forming layer contains at least a photosensitive silver halide, a non-photosensitive organic silver salt, a reducing agent and a binder. The photothermographic material is characterized in that: (1) a silver iodide content of the photosensitive silver halide is not less than 40 mole %; (2) the binder is a hydrophilic binder; (3) the image forming layer contains a silver iodide complexing agent; and (4) the image forming layer contains, as a silver carrier, at least one compound represented by the following Formula (I) or (II):

Formula (I)

Formula (II)

(wherein Q represents an atomic group that is necessary to form a 5 or 6-membered imide ring).

16 Claims, No Drawings

PHOTOTHERMOGRAPHIC MATERIAL AND IMAGE FORMING METHOD USING THE SAME

CROSS-REFERENCE TO RELATED APPLICATION

This application claims under 35USC 119 from Japanese Patent Application No. 2004-268560, the disclosure of which is incorporated by reference herein.

BACKGROUND OF THE INVENTION

1. Field of the Invention

The present invention relates to a photothermographic material and an image forming method using the same.

2. Description of the Related Art

In recent years, decrease in the amount of processing liquid waste in the field of films for medical imaging has been keenly desired from the viewpoints of environmental protection and economy of space. For this reason, techniques regarding photothermographic materials for medical diagnosis and graphic arts, which can be exposed efficiently by laser image setters or laser imagers and can form clear black-toned images of high resolution and sharpness, is required. According to the photothermographic materials described above, thermal development systems which do not require liquid processing chemicals, are simpler, and do not damage the environment can be supplied to customers.

While similar requirements also exist in the field of general image forming materials, images for medical imaging require a particularly high image quality excellent in sharpness and granularity since fine representation is required, and are characterized in that images of blue-black tones are preferred from the viewpoint of easy diagnosis. At present, various kinds of hard copy systems utilizing dyes or pigments such as ink jet printers and electrophotographic systems have been marketed as general image forming systems, but they are not satisfactory as output systems for medical images.

Thermal image forming systems utilizing organic silver salts are described in a number of documents. A photothermographic material generally comprises an image forming layer in which a catalytically active amount of photocatalyst (for example, a silver halide), a reducing agent, a reducible silver salt (for example, an organic silver salt), and if necessary, a toning agent for controlling the color tone of silver, dispersed in a binder. A photothermographic material forms a black silver image by being heated to a high temperature (for example, 80° C. or higher) after image wise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed in the exposed region. Further, the Fuji Medical Dry Imager FM-DP L is has been marketed as a medical image forming system using a photothermographic material.

Thermal image forming systems utilizing organic silver salts can be produced by solvent application, as well as by applying and drying a coating solution that contains an aqueous dispersion of polymer particles as a main component of a binder. The latter method does not require an operation of, for example, recovering a solvent, and therefore can be carried out with simple production facilities and is environmentally friendly. Accordingly, the latter method is advantageous for mass production. However, since the coating solution does not have setting ability, a coated layer may be turbulent due to an air flow for drying the applied coating solution, resulting in non-uniformity of the dried layer.

Use of a hydrophilic binder such as gelatin as the binder has been proposed (see, for example, U.S. Pat. No. 6,713,241 and Japanese Patent Application Laid-pen (JP-A) No. 2004-110038). However, such methods have problems such as difficulty in obtaining high image density, a high degree of fogging, and unsatisfactory color tone of images.

A layer in a photothermographic material needs to contain chemical components necessary for forming an image, in advance. These chemical components may affect storage stability before use of the photothermographic materials. Further, even after an image has been formed through thermal development on a photothermographic material, such chemical components remain in the layer thereof in an unreacted state or in the form of reaction products. These chemical components remaining in the layer may affect transparency of the layer and color tone of the image, as well as preservability of the resulting image, and particularly, may cause an increase in fog due to "printout".

Image processing techniques in which image information is digitized and necessary information is outputted at a terminal through communication, have been developed and widely used in the field of medical images and printing industries. In many cases, semiconductor lasers are used for outputting image information. With progress in practical application of blue lasers, high-resolution image systems using blue lasers are attracting attention. Conventionally, silver halide photosensitive materials for wet development have been used. However, there have been strong demands for developing a highly-sensitive photosensitive material for dry development that can record an image with blue-laser beam.

SUMMARY OF THE INVENTION

According to the present invention, a photothermographic material with improved coating surface condition and good image quality, and an image forming method in which the photothermographic material is exposed with blue light are provided.

A first aspect of the invention is a photothermographic material including a support, and an image forming layer provided on at least one side of the support, the image forming layer containing at least a photosensitive silver halide, a non-photosensitive organic silver salt, a reducing agent and a binder, wherein:

(1) the content of silver iodide in the photosensitive silver halide is not less than 40 mole %;

(2) the binder is a hydrophilic binder;

(3) the image forming layer contains a silver iodide complexing agent; and (4) the image forming layer contains, as a silver carrier, at least one compound represented by the following Formula (I) or (II):

Formula (I)

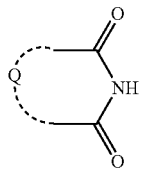

(wherein Q represents an atomic group necessary for forming a 5 or 6-membered imide ring);

Formula (II)

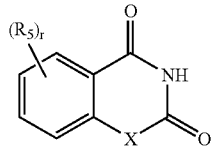

(wherein: $R_5$ independently represents a hydrogen atom, alkyl group, cycloalkyl group, alkoxy group, alkylthio group, arylthio group, hydroxyl group, halogen atom or $N(R_8R_9)$, where $R_8$ and $R_9$ each independently represents a hydrogen atom, alkyl group, aryl group, cycloalkyl group, alkenyl group or heterocyclic group; r represents 0, 1 or 2; $R_8$ and $R_9$ may be bonded to each other to form a substituted or unsubstituted 5 to 7-membered hetero ring; two groups represented by $R_5$ may be linked together to form an aromatic, heteroaromatic, alicyclic or heterocyclic condensed ring; and X represents O, S, Se or $N(R_6)$, where $R_6$ represents a hydrogen, alkyl group, aryl group, cycloalkyl group, alkenyl group or heterocyclic group).

A second aspect of the invention is the photothermographic material as described in the first aspect, wherein the silver iodide content is not less than 80 mole %.

A third aspect of the invention is the photothermographic material as described in the second aspect, wherein the silver iodide content is not less than 90 mole %.

A fourth aspect of the invention is the photothermographic material as described in the third aspect, wherein the silver iodide content is not less than 95 mole %.

A fifth aspect of the invention is the photothermographic material as described in the first aspect, wherein the image forming layer contains at least one selected from polyacrylamides and derivatives thereof.

A sixth aspect of the invention is the photothermographic material as described in the fifth aspect, wherein the image forming layer contains grains of a non-photosensitive organic silver salt are formed in the presence of at least one selected from the polyacrylamides and derivatives thereof.

A seventh aspect of the invention is the photothermographic material as described in the first aspect, wherein the non-photosensitive organic silver salt is formed of nano-grains.

An eighth aspect of the invention is the photothermographic material as described in the seventh aspect, wherein a mean grain size of the nano-grains is in a range from 10 nm to 1000 nm.

A ninth aspect of the invention is the photothermographic material as described in the first aspect, wherein the reducing agent is a compound represented by the following formula (R):

Formula (R)

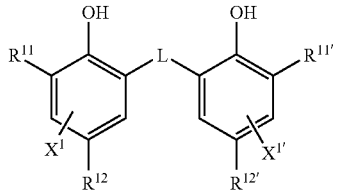

(wherein: $R^{11}$ and $R^{11'}$ each independently represent an alkyl group, where at least one of $R^{11}$ and $R^{11'}$ is a seconadry or tertiary alkyl group; $R^{12}$ and $R^{12'}$ each independently represent a hydrogen atom or a substituent that is substitutable on a benzene ring; L represents —S— or —$CHR^{13}$—, where $R^{13}$ represents a hydrogen atom or alkyl group; and $X^1$ and $X^{1'}$ each independently represent a hydrogen atom or a substituent that is substitutable on a benzene ring).

A tenth aspect of the invention is the photothermographic material as described in the ninth aspect, wherein the hydrophilic binder is gelatin or a gelatin derivative.

An eleventh aspect of the invention is the photothermographic material as described in the tenth aspect, wherein a ratio by mass of the non-photosensitive organic silver salt to the binder in the image forming layer is in a range from 1.0 to 2.5.

A twelfth aspect of the invention is an image forming method, wherein the photothermographic material as described in the first aspect is exposed to light having a wavelength in a range from 350 nm to 450 nm.

A thirteenth aspect of the invention is the image forming method as described in the twelfth aspect, wherein the light having a wavelength in a range from 350 nm to 450 nm is laser light.

A fourteenth aspect of the invention is the image forming method as described in the thirteenth aspect, wherein the laser light is light emitted from a semiconductor laser element.

A fifteenth aspect of the invention is the image forming method as described in the fourteenth aspect, wherein the semiconductor laser element is a blue semiconductor laser element.

A sixteenth aspect of the invention is the image forming method as described in the twelfth aspect, wherein the photothermographic material is thermally developed at a linear velocity of not less than 23 mm/second.

The present inventors have continuously explored for a new photothermographic material suitable for blue light exposure that has a good coating surface condition, and have found that this task can be solved by using a hydrophilic binder as a binder in an image forming layer; in combination of, as a halogen composition, a photosensitive silver halide having a high iodine content, i.e., a silver iodide content of 40 mole %, which has not been paid attention in prior art, and a silver iodide complexing agent that forms a complex specifically with a silver iodide; and by the use of, as a silver ion carrier, a compound represented by Formula (I) or (II) shown above, to achieve the invention as described in the first aspect. High quality images with high sensitivity and less turbidity provided by the photothermographic material of the invention are realized by this combination.

Further, the present inventors have found more preferable compositions to achieve the inventions as described in the second to eleventh aspects. In addition, as the image forming method for use with the photothermographic material of the invention, the inventions as described in the twelfth to sixteenth aspects have been achieved. The present inventors have found that the photothermographic material of the invention exerts its effect particularly when the material is exopsed with blue light.

DETAILED DESCRIPTION OF THE INVENTION

Hereinafter, the present invention is described in detail.

1. Photothermographic Material

A photothermographic material of the invention includes, on at least one side of a support thereof, an image forming layer containing at least a photosensitive silver halide, a non-photosensitive organic silver salt, a reducing agent and a binder. The image forming layer in the invention is formed by one or more layers provided on the support, and contains additional materials such as an anti-fogging agent, a development accelerator, a coating aid and other auxiliaries, as required. The photothermographic material of the invention preferably includes a non-photosensitive layer. The non-photosensitive layer in the invention may include a single layer or multiple layers.

The image forming layer in the invention contains a binder that is formed by 50% by mass or more of hydrophilic binder component, and, as a silver ion carrier, at least one of compounds having imide groups represented by Formula (I) or (II).

The photosensitive silver halide in the invention has a silver iodide content of not less than 40 mole %, preferably not less than 80 mole %, more preferably not less than 90 mole %, and even more preferably not less than 95 mole %.

The photothermographic material of the invention contains a silver iodide complexing agent. The photothermographic material of the invention is exposed to light having a wavelength ranging from 350 nm to 450 nm, preferably to laser light, more preferably to light emitted from a semiconductor laser element, and particularly preferably to light emitted from a blue semiconductor laser element.

The photothermographic material of the invention preferably contains at least one selected from polyacrylamides and derivatives thereof, more preferably contains grains of a non-photosensitive organic silver salt formed in the presence of the at least one selected from polyacrylamides and derivatives thereof, and even more preferably the grains are nano-grains of the above non-photosensitive organic silver salt.

In the invention, the hydrophilic binder in the image forming layer is preferably gelatin or a gelatin derivative.

It is preferable that the photothermographic material of the invention is thermally developed at a linear velocity of not less than 23 mm/second.

(Organic Silver Salt)

1) Composition

The organic silver salt according to the invention is relatively stable to light but serves as to supply silver ions and forms silver images when heated to 80° C. or higher in the presence of an exposed photosensitive silver halide and a reducing agent. The organic silver salt may be any organic material containing a source capable of reducing silver ions. Such non-photosensitive organic silver salt is disclosed, for example, in JP-A No. 10-62899 (paragraph Nos. 0048 to 0049), EP-A No. 0803764A1 (page 18, line 24 to page 19, line 37), EP-A No. 0962812A1, JP-A Nos. 11-349591, 2000-7683, and 2000-72711, and the like. A silver salt of organic acid, particularly, a silver salt of long chained fatty acid carboxylic acid (having 10 to 30 carbon atoms, preferably, having 15 to 28 carbon atoms) is preferable. Preferred examples of the organic silver salt can include, for example, silver lignocerate, silver behenate, silver arachidinate, silver stearate, silver oleate, silver laurate, silver capronate, silver myristate, silver palmitate, silver erucate and mixtures thereof. In the present invention, among the organic silver salts, it is preferred to use an organic silver salt with the silver behenate content of 50 mole % or more, more preferably, 85 mole % or more, and further preferably, 95 mole % or more. Further, it is preferred to use an organic silver salt with the silver erucate content of 2 mole % or less, more preferably, 1 mole % or less, and further preferably, 0.1 mole % or less.

It is preferred that the content of the silver stearate is 1 mole % or less. When the content of the silver stearate is 1 mole % or less, a silver salt of organic acid having low Dmin, high sensitivity and excellent image stability can be obtained. The content of the silver stearate above-mentioned, is preferably 0.5 mole % or less, more preferably, the silver stearate is not substantially contained.

Further, in the case the silver salt of organic acid includes silver arachidinic acid, it is preferred that the content of the silver arachidinic acid is 6 mole % or less in order to obtain a silver salt of organic acid having low Dmin and excellent image stability The content of the silver arachidinate is more preferably 3 mole % or less.

The organic silver salt in the invention is preferably formed of nano-grains having a mean grain size preferably in the range from 10 nm to 1000 nm, and more preferably in the range from 30 nm to 400 nm.

If the nano-grains of the organic silver salt has a mean grain size smaller than this range, problems are caused such as increase in fogging, increase in fogging of unused photothermographic materials during storage thereof, and increase in fogging of processed images during storage thereof.

In contrast, if the nano-grains of the organic silver salt has a mean grain size greater than this range, problems are caused such as increase in haze of a coated layer, retardation of development, and increase in sedimentation of solid components during a long-term storage of a dispersion of the organic silver salt. Accordingly, it is preferable to use the nano-grains of the organic silver salt having a mean grain size within the above range.

$$x=b/a$$

2) Shape

There is no particular restriction to the shape of the organic silver salt usable in the invention and it may needle-like, bar-like, tabular, or flaky shape.

In the invention, a flaky shaped organic silver salt is preferred. Short needle-like particle having a ratio of a major axial length to minor axial length of 5 or less, rectangular, cuboidal or potato-like amorphous shaped particle is also preferably used. Such organic silver particle has a feature less susceptible to occurrence of fogging during thermal development compared with long needle-like particles having a ratio of a major axial length to a minor axial length of 5 or more. Particularly, a particle having a ratio of the major axial length to the minor axial length of 3 or less is preferred since it can improve the mechanical stability of the coating layer. In the present specification, the flaky shaped organic silver salt is defined as described below. When an organic acid silver salt is observed under an electron microscope, calculation is made while approximating the shape of an organic acid silver salt particle to a rectangular pallalelopiped and assuming each side of the rectangular pallalelopiped as a, b, c from the shorter side (c may be identical with b) and determining x based on numerical values a, b for the shorter side as below.

As described above, x is determined for the particles by the number of about 200 and those satisfying the relation x (average)≧1.5 as an average value x are defined as a flaky shape. The relation is preferably 30≧x (average)≧1.5 and, more preferably, 15≧x (average)≧1.5. By the way, needle-like is expressed as 1≦x (average)<1.5.

In the flaky shaped particle, "a" can be regarded as a thickness of a tabular particle having a principal plane with "b" and "c" being as the sides. "a" in average is preferably 1 nm to 300 nm and, more preferably, 5 nm to 100 nm. "c"/"b" in average preferably 1 to 9, more preferably, 1 to 6, further preferably, 1 to 4 and, most preferably, 1 to 3.

In the invention, a sphere-equivalent diameter is measured by, first, directly photographing a sample with an electron microscope, and then by subjecting the obtained negative image to image-processing.

With respect to the flaky shaped grains, a sphere-equivalent diameter/"a" of a grain is defined as an aspect ratio. The aspect ratio of flaky shaped grains is preferably in the range from 1.1 to 30, and more preferably in a range from 1.1 to 15, in view of a low tendency of coagulation occurring in the photothermographic material to provide good image preservability.

As the particle size distribution of the organic silver salt, monodispersion is preferred. In the monodispersion, the percentage for the value obtained by dividing the standard deviation of each of the minor axial length and the major axial length by the minor axial length and the major axial length, respectively, is preferably, 100% or less, more preferably, 80% or less and, further preferably, 50% or less. The shape of the organic silver salt can be determined by measuring a transmission type electron microscopic image of the dispersion of an organic silver salt. Another method of measuring the monodispersion is a method of determining of the standard deviation of the volume weighted mean diameter of the organic silver salt in which the percentage for the value defined by the volume weighted mean diameter (variation coefficient), is preferably, 100% or less, more preferably, 80% or less and, further preferably, 50% or less. The monodispersion can be determined from particle size (volume weighted mean diameter) obtained, for example, by a measuring method of irradiating a laser beam to an organic silver salt dispersed in a liquid, and determining a self correlation function relative to the change of the fluctuation of scattered light with time.

3) Preparing Method

Methods known in the art may be applied to the method for producing the organic silver salt used in the invention, and to the dispersion method thereof. For example, reference can be made to JP-A No. 10-62899, EP-A Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870 and 2002-107868, and the like.

The organic silver salt for use in the invention preferably contains a dispersant. As the dispersant, a compound represented by either of the formulae shown below is preferably used.

The dispersant may be added during preparation of the organic silver salt, or during dispersion thereof.

Formula (W1)

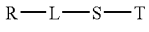

Formula (W2)

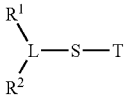

R represents a hydrophobic group. At least one of $R_1$ and $R_2$ is a hydrophobic group. L represents a divalent linking group. T represents an oligomer moiety.

The number of the hydrophobic group(s) is determined by the linking group L. The hydrophobic group is selected from saturated or unsaturated alkyl groups, arylalkyl groups and alkylaryl groups, in which the alkyl moiety may be linear or branched. Preferably, the hydrophobic R, $R_1$ and $R_2$ have 8 to 21 carbon atoms. The linking group L is linked to the hydrophobic group(s) via a simple chemical bond(s), and to the oligomer moiety T via a thio bond (—S—). Examples of typical linking groups for substances accompanying one hydrophobic group are shown in the formulae below in Italic font.

Formula (Wa)

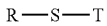

Formula (Wb)

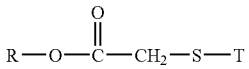

Formula (Wc)

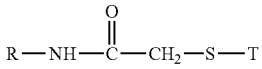

Examples of typical linking groups for substances accompanying two hydrophobic groups are shown in the formulae below in Italic font.

Formula (Wd)

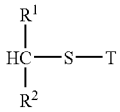

Formula (We)

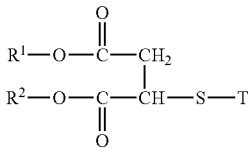

Formula (Wf)

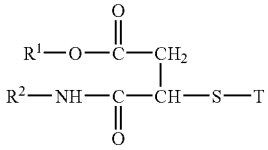

The oligomeric group T is based on oligomerization of vinyl monomers having an amide functional group. The vinyl moiety thereof provides a path for oligomerization, and the amide moiety thereof provides a non-ionic polar group that forms a hydrophilic functional group (after oligomerization). The oligomeric group T can be formed from a single type of monomer source, or can be formed from a mixture of monomers as long as the resulting oligomer chain is sufficiently hydrophilic to dissolve or disperse the resulting surface active substance in water. Typical monomers used to form the oligomer chain T are acrylamides, methacrylamides, acrylamide derivatives, methacrylamide derivatives, and 2-vinyl pyrolidone. Among them, the last one is less preferable because of an adverse photographic effect that is sometimes found with polyvinyl pyrolidone (PVP).

These monomers can be represented by two Formulae shown below.

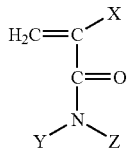

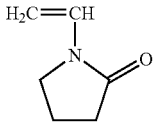

Acrylamides, methacrylamides, or derivatives thereof 2-vinyl pyrolidone

X represents a hydrogen atom or an alkyl group having 1 to 10 carbon atoms, and preferably represents a hydrogen atom or a methyl group. Y and Z each represents a hydrogen atom, an alkyl group having 1 to 10 carbon atoms, or a substituted alkyl group having 1 to 10 carbon atoms, and preferably represents a hydrogen atom, a methyl group, an ethyl group or —$C(CH_2OH)_3$. X and Y may be the same or different.

A repeating unit of the oligomeric group T is not more than 20, and preferably from 5 to 15. Specific examples thereof for use in the invention are shown below, however, these examples are not intended to limit the invention.

BUN-1

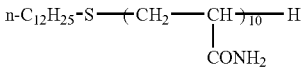

BUN-2

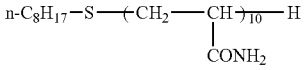

BUN-3

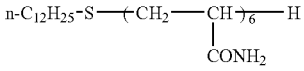

BUN-4

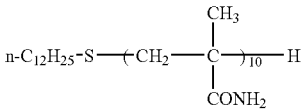

BUN-5

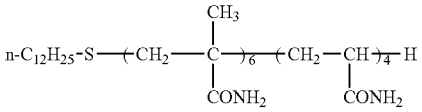

BUN-6

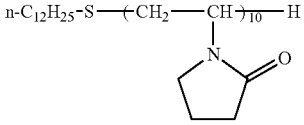

BUN-7

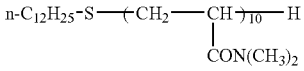

BUN-8

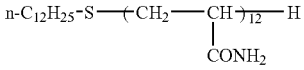

BUN-9

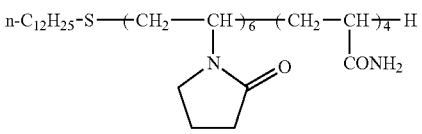

-continued

BUN-10

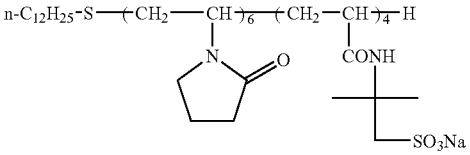

An oligomer surfactant containing, as a main component, the vinyl polymer having the amide functional group can be produced by methods known in the art or simple modifications of such methods. An exemplary preparation method is described below. An aqueous nano-grain silver carboxylate dispersion can be formed by a medium pulverizing method, which includes the following steps:

(A) preparing a silver carboxylate dispersion that contains silver carboxylate, water as a carrier for a carboxylate, and a surface modifier;

(B) mixing the carboxylate dispersion with a hard milling pulverizing having a mean grain diameter of less than 500 μm;

(C) charging the mixture of step (B) into a high speed mill;

(D) milling the mixture of step (C) until a grain diameter distribution of the carboxylate reaches a state where 90% by mass of the carboxylate grains have grain diameters less than 1 μm; and (E) removing the pulverizing medium from the mixture pulverized in step (D).

When a photosensitive silver salt coexists with the organic silver salt during dispersing thereof, fog increases and sensitivity becomes remarkably lower, so that it is more preferred that the photosensitive silver salt is not substantially contained during dispersing process. In the invention, the amount of the photosensitive silver salt to be dispersed in the aqueous dispersion, is preferably, 1 mole % or less, more preferably, 0.1 mole % or less per one mole of the organic acid silver salt in the solution and, further preferably, positive addition of the photosensitive silver salt is not conducted.

In the invention, the photothermographic material can be prepared by mixing an aqueous dispersion of an organic silver salt and an aqueous dispersion of a photosensitive silver salt, but the mixing ratio between the organic silver salt and the photosensitive silver salt can be selected depending on the purpose. The ratio of the photosensitive silver salt to the organic silver salt is, preferably, in the range from 1 mole % to 30 mole %, more preferably, in the range from 2 mole % to 20 mole % and, particularly preferably, 3 mole % to 15 mole %. A method of mixing two or more kinds of aqueous dispersions of organic silver salts and two or more kinds of aqueous dispersions of photosensitive silver salts when mixing thereof is preferably used for controlling the photographic properties.

4) Addition Amount

While an organic silver salt in the invention can be used in a desired amount, a total coating amount of Ag including silver halide is preferably in the range from 0.1 $g/m^2$ to 5.0 $g/m^2$, more preferably 0.3 $g/m^2$ to 3.0 $g/m^2$, and further preferably 0.5 $g/m^2$ to 2.0 $g/m^2$. Particularly, it is preferred that a total coating amount of silver preferably is 1.8 $g/m^2$ or less, and more preferably from 1.6 $g/m^2$ or less, to improve the image stability. Using the preferable reducing agent of the invention, it is possible to obtain a sufficient image density even with such a low amount of silver.

(Reducing Agent)

The photothermographic material of the invention contains a thermal developing agent, which is a reducing agent for the organic silver salt. In the invention, a so-called hindered phenolic reducing agent or a bisphenol agent having a substituent at the ortho-position to the

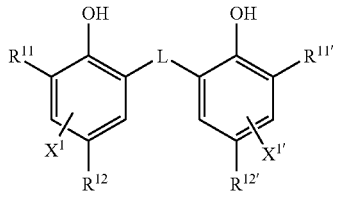

hydroxyl group of a phenolic nucleus is preferred and the compound represented by the following formula (R) is more preferred.

Formula (R)

In formula (R), $R^{11}$ and $R^{11'}$ each independently represent an alkyl group, and at least one is a secondary or tertiary alkyl group. $R^{12}$ and $R^{12'}$ each independently represent a hydrogen atom or a group capable of substituting for a hydrogen atom on a benzene ring. L represents a —S— group or a —$CHR^{13}$— group. $R^{13}$ represents a hydrogen atom or an alkyl group. $X^1$ and $X^{1'}$ each independently represent a hydrogen atom or a group capable of substituting for a hydrogen atom on a benzene ring.

Formula (R) will be described hereinafter in detail.

Hereinafter, the term "alkyl group" includes cycloalkyl groups, unless otherwise specified.

1) $R^{11}$ and $R^{11'}$ $R^{11}$ and $R^{11'}$ each independently represent a substituted or unsubstituted alkyl group having 1 to 20 carbon atoms, with at least one being a secondary or tertiary alkyl group. Substituents for the alkyl group have no particular restriction but preferably include an aryl group, hydroxyl group, alkoxy group, aryloxy group, alkylthio group, arylthio group, acylamino group, sulfoneamide group, sulfonyl group, phosphoryl group, acyl group, carbamoyl group, ester group, ureido group, urethane group and halogen atom.

2) $R^{12}$ and $R^{12'}$, $X^1$ and $X^{1'}$ $R^{12}$ and $R^{12'}$ each independently represent a hydrogen atom or a group capable of substituting for a hydrogen atom on a benzene ring. $X^1$ and $X^{1'}$ each independently represent a hydrogen atom or a group capable of substituting for a hydrogen atom on a benzene ring. Each of the groups capable of substituting for a hydrogen atom on the benzene ring preferably include an alkyl group, aryl group, halogen atom, alkoxy group, and acylamino group.

3) L

L represents a —S— group or a —$CHR^{13}$— group. $R^{13}$ represents a hydrogen atom or an alkyl group having 1 to 20 carbon atoms in which the alkyl group may have a substituent. Specific examples of unsubstituted alkyl groups for $R^{13}$ include, for example, methyl group, ethyl group, propyl group, butyl group, heptyl group, undecyl group, isopropyl group, 1-ethylpentyl group, 2,4,4-trimethylpentyl group, cyclohexyl group, 2,4-dimethyl-3-cyclohexenyl group, and 3,5-dimethyl-3-cyclohexenyl group. Examples of substituents for the alkyl group include, like the substituents of $R^{11}$, a halogen atom, an alkoxy group, alkylthio group, aryloxy group, arylthio group, acylamino group, sulfoneamide group, sulfonyl group, phosphoryl group, oxycarbonyl group, carbamoyl group, and sulfamoyl group.

4) Preferred Substituents $R^{11}$ and $R^{11'}$ are, preferably, secondary or tertiary alkyl groups having 1 to 15 carbon atoms and can include, specifically, isopropyl group, t-butyl group, t-amyl group, t-octyl group, cyclohexyl group, cyclopentyl group, 1-methylcyclohexyl group, and 1-methylcyclopropyl group. $R^{11}$ and $R^{11'}$ each represent, more preferably a t-butyl group, t-amyl group, 1-methyl cyclohexyl group, t-butyl group being most preferred.

$R^{12}$ and $R^{12'}$ are, preferably, an alkyl group having 1 to 20 carbon atoms and can include, specifically, methyl group, ethyl group, propyl group, butyl group, isopropyl group, t-butyl group, t-amyl group, cyclohexyl group, 1-methylcyclohexyl group, benzyl group, methoxymethyl group and methoxyethyl group. More preferred are methyl group, ethyl group, propyl group, isopropyl group, and t-butyl group.

$X^1$ and $X^{1'}$ are, preferably, a hydrogen atom, a halogen atom, or an alkyl group, and more preferably, a hydrogen atom.

L is preferably a group —$CHR^{13}$—.

$R^{13}$ is, preferably, a hydrogen atom or an alkyl group having 1 to 15 carbon atoms. As the alkyl group, linear alkyl groups and cycloalkyl groups are preferably used. Alkyl groups having a C=C group in the molecule are also preferably used. Preferable alkyl groups include methyl group, ethyl group, propyl group, isopropyl group and 2,4,4-trimethylpentyl group, cyclohexyl group, 2,4-dimethyl-3-cyclohexenyl group, and 3,5dimethyl-3-cyclohexenyl group. Particularly preferable R13 group includes a hydrogen atom, methyl group, ethyl group, propyl group, isopropyl group and 2,4-dimethyl-3-cyclohexenyl group.

When $R^{11}$, $R^{11'}$ each represent a tertiary alkyl group and $R^{12}$, $R^{12'}$ each represent a methyl group, $R^{13}$ preferably represents a primary or seconadry alkyl group having 1 to 8 carbon atoms (such as a methyl, ethyl, propyl, isopropyl, or 2,4-dimethyl-3-cyclohexenyl group).

When $R^{11}$, $R^{11'}$ each represents a tertiary alkyl group and $R^{12}$, $R^{12'}$ each represent an alkyl group other than a methyl group, $R^{13}$ preferably represents a hydrogen atom.

When $R^{11}$, $R^{11'}$ each represent an alkyl group other than a tertiary alkyl group, $R^{13}$ preferably represents a hydrogen atom or a secondary alkyl group, and particularly preferably represents a secondary alkyl group. The secondary alkyl group for $R^{13}$ is preferably an isopropyl group or a 2,4-dimethyl-3-cyclohexenyl group.

The reducing agent described above shows different thermal developing characteristics or developed-silver color tones or the like depending on the combination of $R^{11}$, $R^{11'}$ and $R^{12}$, $R^{12'}$, as well as $R^{13}$. Since these characteristics can be controlled by using two or more kinds of reducing agents at various mixing ratios, it is preferred to use two or more kinds of reducing agents in combination depending on the purpose.

Specific examples of the reducing agents of the invention including the compounds represented by formula (R) according to the invention are shown below, but the invention is not restricted to them.

R1-1
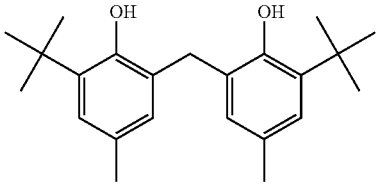
R1-2
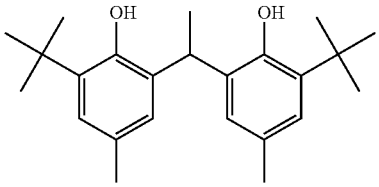
R1-3
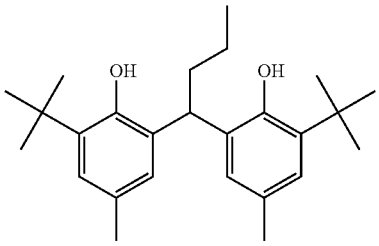
R1-4
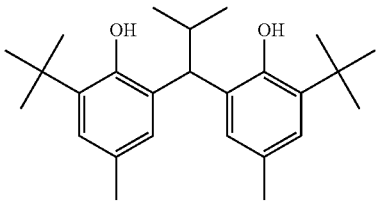
R1-5
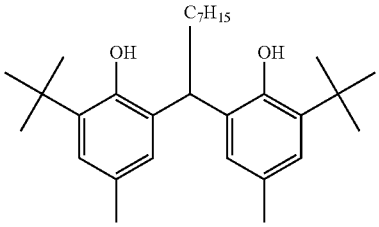
R1-6
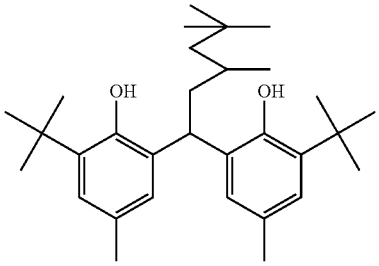
R1-7
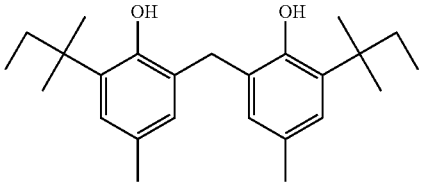
-continued
R1-8
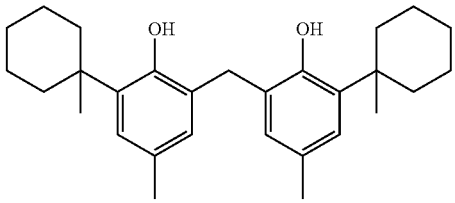
R1-9
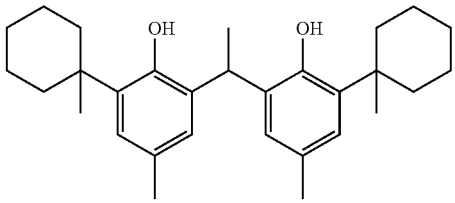
R1-10
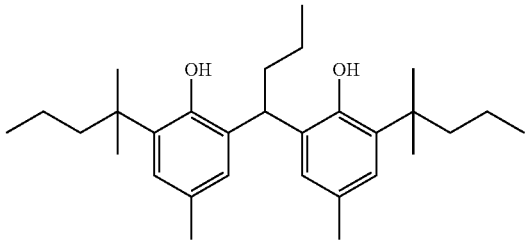
R1-11
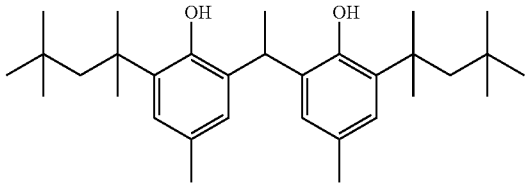
R1-12
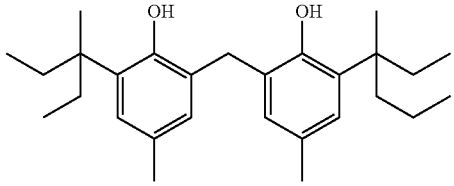
R1-13
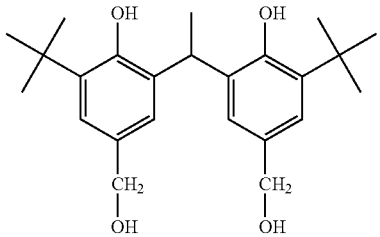
R1-14
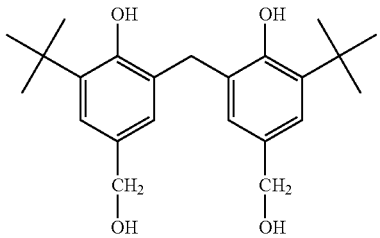

-continued
R1-15
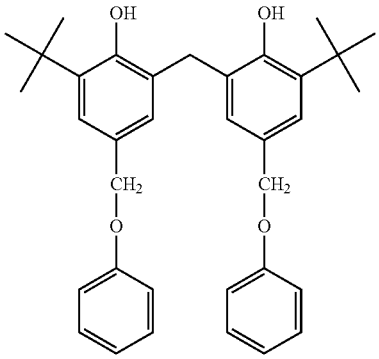
R1-16
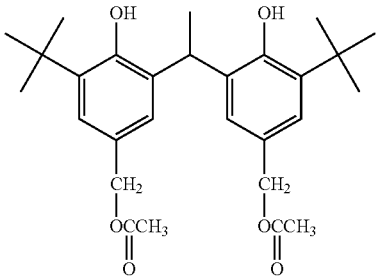
R1-17
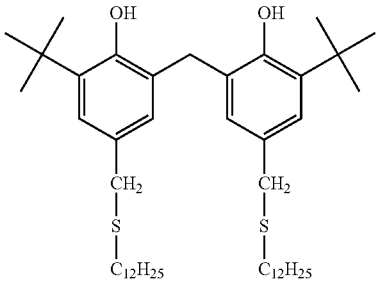
R1-18
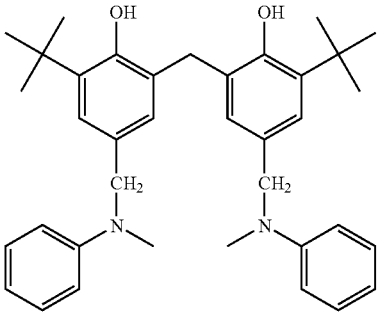
R1-19
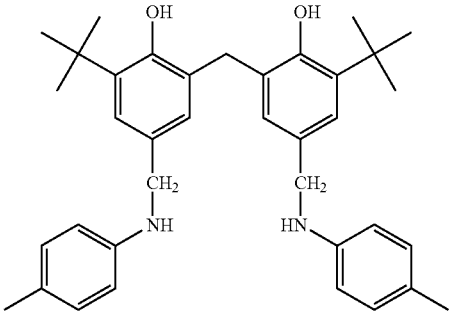
-continued
R1-20
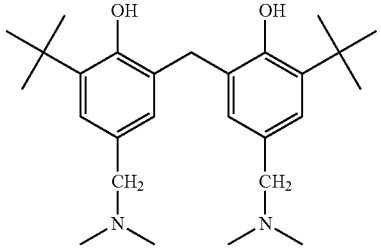
R1-21
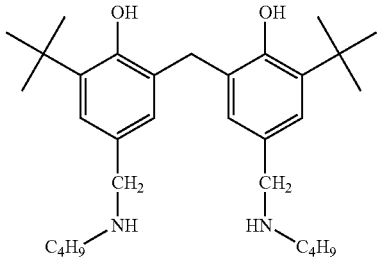
R1-22
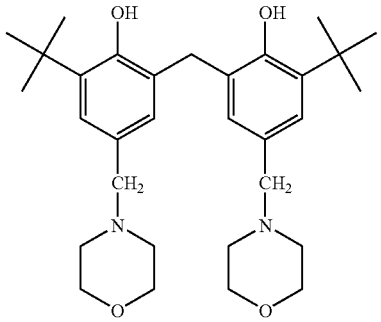
R1-23
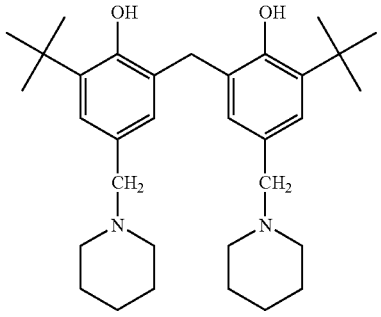
R1-24
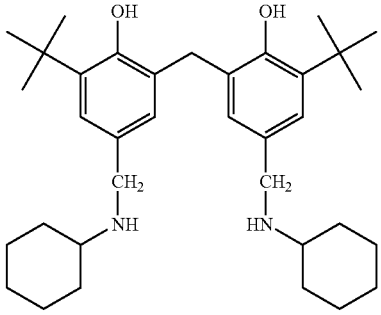

-continued
R1-25
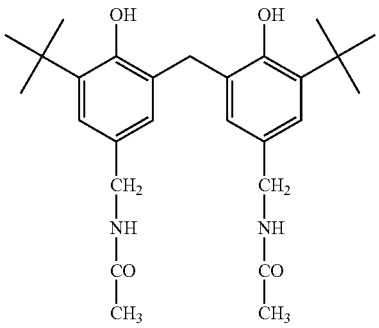
R1-26
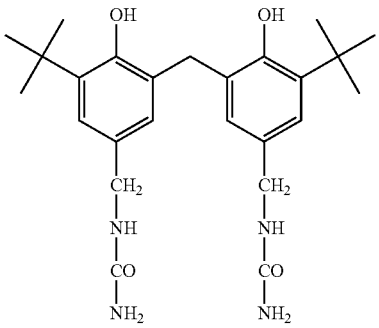
R1-27
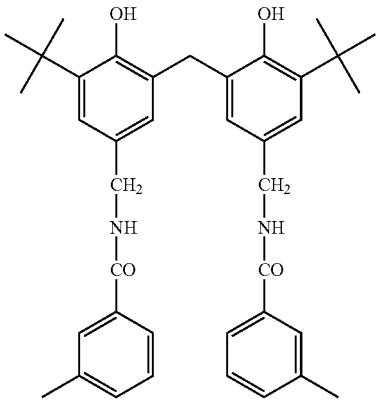
R1-28
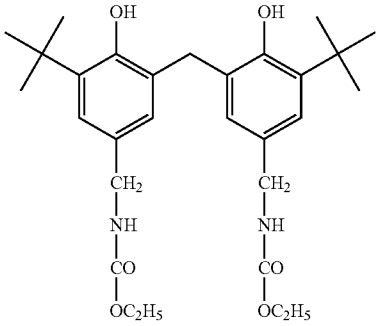
-continued
R1-29
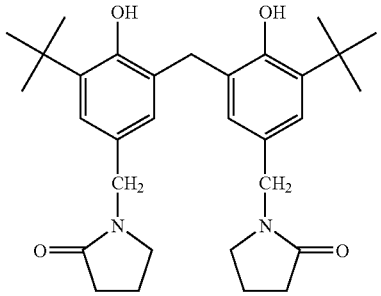
R1-30
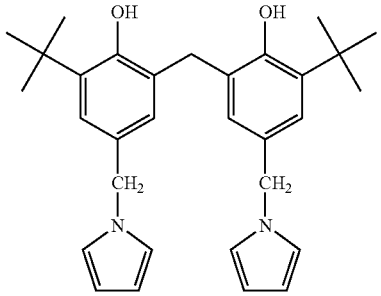
R1-31
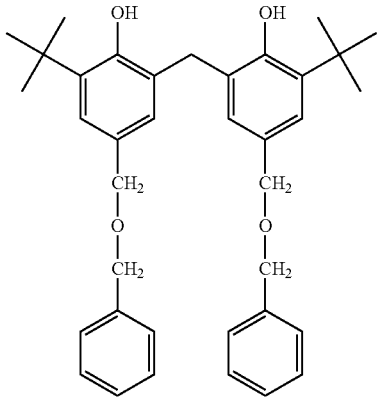
R1-32
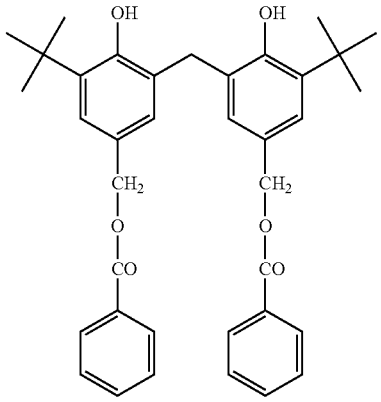

-continued

R1-33

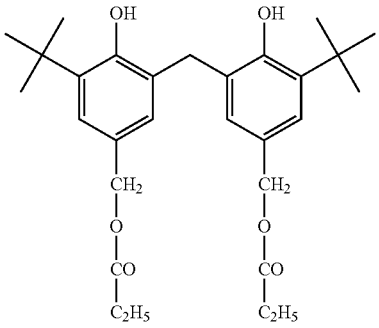

R1-34

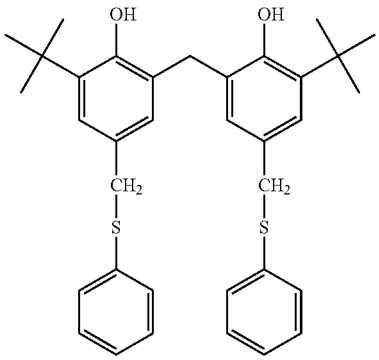

R1-35

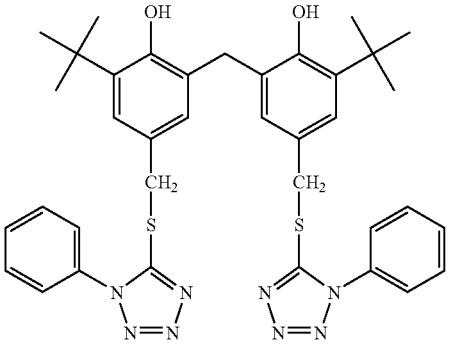

R1-36

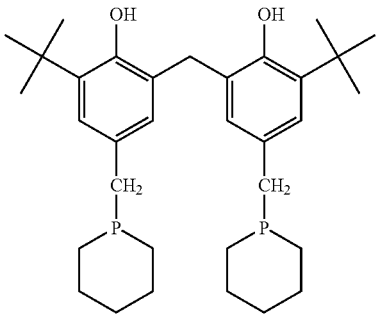

As preferred reducing agents of the invention other than those above, there can be mentioned compounds disclosed in JP-A Nos. 2001-188314, 2001-209145, 2001-350235, and 2002-156727 and EP 1278101A2.

In the invention, the addition amount of the reducing agent is, preferably, from 0.1 g/m$^2$ to 3.0 g/m$^2$, more preferably, 0.2 g/m$^2$ to 2.0 g/m$^2$ and, further preferably 0.3 g/m$^2$ to 1.0 g/m$_2$. It is, preferably, contained in the range of 5 mol % to 50 mol % per one mol of silver in the image forming layer, more preferably, 8 mol % to 30 mol % and, further preferably, 10 mol % to 20 mol %.

The reducing agent can be contained in any of the layers on the side of the image forming layer, but is preferably contained in the image forming layer.

In the invention, the reducing agent may be incorporated into photothermographic material by being added into the coating solution, such as in the form of a solution, an emulsion dispersion, a solid fine particle dispersion, and the like.

Well known emulsion dispersion methods which can be used are dissolving oils such as dibutyl phthalate, tricresyl phosphate, dioctyl sebacate, or tri(2-ethylhexyl) phosphate, using auxiliary solvents such as ethyl acetate and cyclohexanone, adding a surfactant such as sodium dodecyl benzene sulphonate, sodium oleoyl-N-methyl taurate, and sodium di(2-ethylhexyl) sulfosuccinate, and then mechanically manufacturing the emulsion dispersion. Here, in order to adjust the viscosity and refractive index of the oil drops it is preferable to add polymers such as alpha methyl styrene oligomer and poly (t-butylacrylamide).

As solid fine particle dispersion method, there can be mentioned a method comprising dispersing the powder of the reducing agent in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surfactant (for instance, an anionic surfactant such as sodium triisopropylnaphthalenesulfonate (a mixture of compounds having the isopropyl groups in different substitution sites)). In the mills enumerated above, generally used as the dispersion media are beads made of zirconia and the like, and the dispersion may be contaminated with Zr and the like eluted from the beads. Although depending on the dispersing conditions, the amount of Zr and the like generally contaminated in the dispersion is in the range from 1 ppm to 1000 ppm. It is practically acceptable so long as Zr is contaminated in an amount of 0.5 mg or less per 1 g of silver. Preferably, a preservative (for instance, sodium benzoisothiazolinone salt) is added in the water dispersion.

In the invention, furthermore, the reducing agent is preferably used as a solid particle dispersion, and the reducing agent is added in the form of fine particles having average particle size from 0.01 μm to 10 μm, and more preferably, from 0.05 μm to 5 μm, and further preferably, from 0.1 μm to 2 μm. In the invention, other solid dispersions are preferably used with this particle size range.

Development Accelerator

In the photothermographic material of the invention, a development accelerator is preferably added. A preferable development accelerator in the case of addition is a sulfonamidephenol compound represented by the Formula (A) in JP-A Nos. 2000-267222 and 2000-330234, a hindered phenol compound represented by the general formula (II) in JP-A No. 2001-92075, a hydrazine compound represented by the general formula (I) in JP-A Nos. 10-62895 and 11-15116, by the general formula (D) in JP-A No. 2002-156727 and by the general formula (1) in JP-A No. 2002-278017, or a phenol or naphthol compound represented by the general formula (2) in JP-A No. 2001-264929. A phenol compound described in JP-A Nos. 2002-311533 and 2002-341484 is also preferred. In particular, a naphthol compound described in JP-A No. 2003-66558 is preferred. Such development accelerator is used within the range of 0.1 to 20 mole % with respect to the reducing agent, preferably 0.5 to 10 mole % and more preferably 1 to 5 mole %.

It can be introduced into the photosensitive material by a method similar to that for the reducing agent, and it is particularly preferably added as a solid dispersion or an emulsified dispersion in the case of an aqueous coating liquid. In the case that the development acclerator is added to the photosensitive material in the form of an emulsified dispersion, the addition is preferably made as an emulsified dispersion prepared by the use of a high-boiling point solvent which is solid at normal temperature, and a low-boiling point auxiliary solvent, or as so-called oilless emulsified dispersion without utilizing the high-boiling point solvent.

In the invention, among the aforementioned development accelerator, more preferred are a hydrazine compound described in JP-A Nos. 2002-156727 and 2002-278017, and a naphthol compound described in JP-A No. 2003-66558.

In the invention, a particularly preferred development accelerator is compounds represented by the following formulas (A-1) and (A-2).

Formula (A-1)

$Q_1$—NHNH—$Q_2$

In the formula, $Q_1$ represents an aromatic group or a heterocyclic group bonded at a carbon atom to —NHNH—$Q_2$; and $Q_2$ represents a carbamoyl group, an acyl group, an alkoxycarbonyl group, an aryloxycarbonyl group, a sulfonyl group or a sulfamoyl group.

In Formula (A-1), the aromatic group or the heterocyclic group represented by $Q_1$ is preferably a 5- to 7-membered unsaturated ring. Preferred examples include a benzene ring, a pyridine ring, a pyradine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring and a thiophene ring, and a condensed ring formed by mutual condensation of these rings is also preferable.

These rings may have a substituent, and, in the case two or more substituents are present, such substituents may be mutually the same or different. Examples of the substituent include a halogen atom, an alkyl group, an aryl group, a carbonamide group, an alkylsulfonamide group, an arylsulfonamide group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group and an acyl group. In the case such substituent is a substitutable group, it may further have a substituent, and examples of preferred substituent include a halogen atom, an alkyl group, an aryl group, a carbonamide group, an alkylsulfonamide group, an arylsulfonamide group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group and an acyloxy group.

A carbamoyl group represented by $Q_2$ preferably has 1 to 50 carbon atoms, more preferably 6 to 40 carbon atoms, and can be, for example, unsubstituted carbamoyl, methylcarbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl) carbamoyl, N-octadecylcarbamoyl, N-{3-2,4-tert-pentylphenoxy)propyl}carbamoyl, N-(2-hexyldecyl) carbamoyl, N-phenylcarbamoyl, N-(4-dodecyloxyphenyl) carbamoyl, N-(2-chloro-5-dodecyloxylcarbonylphenyl) carbamoyl, N-naphthylcarbamoyl, N-3-pyridylcarbamoyl, or N-benzylcarbamoyl.

An acyl group represented by $Q_2$ preferably has 1 to 50 carbon atoms, more preferably 6 to 40 carbon atoms, and can be, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, or 2-hydroxymethylbenzoyl. An alkoxycarbonyl group represented by $Q_2$ preferably has 2 to 50 carbon atoms, more preferably 6 to 40 carbon atoms, and can be, for example, methoxycarbonyl, ethoxycarbonyl, isobutyloxycarbonyl, cyclohexyloxycarbonyl, dodecyloxycarbonyl or benzyloxycarbonyl.

An aryloxycarbonyl group represented by $Q_2$ preferably has 7 to 50 carbon atoms, more preferably 7 to 40 carbon atoms, and can be, for example, phenoxycarbonyl, 4-octyloxyphenoxycarbonyl, 2-hydroxymethylphenoxycarbonyl, or 4-dodecyloxyphenoxycarbonyl. A sulfonyl group represented by $Q_2$ preferably has 1 to 50 carbon atoms, more preferably 6 to 40 carbon atoms, and can be, for example, methylsulfonyl, butylsulfonyl, octylsulfonyl, 2-hexadecylsulfonyl, 3-dodecyloxypropylsulfonyl, 2-octyloxy-5-tert-octylphenylsulfonyl or 4-dodecyloxyphenylsulfonyl.

A sulfamoyl group represented by $Q_2$ preferably has 0 to 50 carbon atoms, more preferably 6 to 40 carbon atoms, and can be, for example, unsubstituted sulfamoyl, N-ethylsulfamoyl, N-(2-ethylhexyl)sulfamoyl, N-decylsulfamoyl, N-hexadecylsulfamoyl, N-{3-(2-ethylhexyloxy) propyl}sulfamoyl, N-(2-chloro-5-dodecyloxycarbonylphenyl)sulfamoyl, or N-(2-tetradecyloxyphenyl)sulfamoyl. A group represented by $Q_2$ may further have, in a substitutable position, a group cited before as a substituent group for a 5- to 7-membered unsaturated ring represented by $Q_1$, and, in the case two or more substituents are present, they may be mutually the same or different.

Next, a preferred range of the compound represented by Formula (A-1) will be explained. For $Q_1$, there is preferred a 5- or 6-membered unsaturated ring, and more preferred is a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thiazole ring, an oxazole ring, an isothiazole ring, an isooxazole ring or a ring formed by a condensation of the foregoing ring with a benzene ring or an unsaturated hetero ring. Also for $Q_2$, there is preferred a carbamoyl group, more preferably a carbamoyl group having a hydrogen atom on a nitrogen atom.

Formula (A-2)

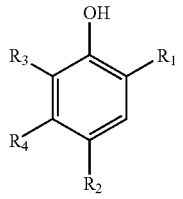

In formula (A-2), $R_1$ represents one selected from an alkyl group, an acyl group, an acylamino group, a sulfoneamide group, an alkoxycarbonyl group, and a carbamoyl group. $R_2$ represents one selected from a hydrogen atom, a halogen atom, an alkyl group, an alkoxy group, an aryloxy group, an alkylthio group, an arylthio group, an acyloxy group, and a carbonate ester group. $R_3$ and $R_4$ each represent a group capable of substituting for a hydrogen atom on a benzene ring which is mentioned as the example of the substituent for formula (A-1). $R_3$ and $R_4$ may bond together to form a condensed ring.

$R_1$ is, preferably, one selected from the following groups having 1 to 20 carbon atoms, namely, those are an alkyl group (for example, methyl group, ethyl group, isopropyl group, butyl group, tert-octyl group, or cyclohexyl group), an acylamino group (for example, acetylamino group, benzoylamino group, methylureido group, or 4-cyanophenylureido group), and a carbamoyl group (for example, n-butylcarbamoyl group, N,N-diethylcarbamoyl group, phenylcarbamoyl group, 2-chlorophenylcarbamoyl group, or 2,4-dichlorophenylcarbamoyl group). Among them, an acylamino group (including ureido group or urethane group) is more preferred.

$R_2$ is preferably one of a halogen atom (more preferably, chlorine atom, bromine atom), an alkoxy group (for example, methoxy group, butoxy group, n-hexyloxy group, n-decyloxy group, cyclohexyloxy group or benzyloxy group), and an aryloxy group (for example, phenoxy group or naphthoxy group).

$R_3$ preferably is one of a hydrogen atom, a halogen atom, and an alkyl group having 1 to 20 carbon atoms, and most preferably a halogen atom. $R_4$ is preferably one of a hydrogen atom, alkyl group, and an acylamino group, and more preferably one of an alkyl group and an acylamino group. Examples of the preferred substituent thereof are identical with those for $R_1$. In a case where $R_4$ is an acylamino group, $R_4$ may preferably bond with $R_3$ to form a carbostyryl ring.

In a case where $R_3$ and $R_4$ in formula (A-2) link together to form a condensed ring, a naphthalene ring is particularly preferred as the condensed ring. The same substituents as the example of the substituents referred to for formula (A-1) may bond to the naphthalene ring. In a case where formula (A-2) is a naphtholic compound, $R_1$, is, preferably, a carbamoyl group. Among them, benzoyl group is particularly preferred. $R_2$ is, preferably, one of an alkoxy group and an aryloxy group and, particularly preferably an alkoxy group.

Preferred specific examples for the development accelerator of the invention are to be described below. The invention is not restricted to them.

(A-1)

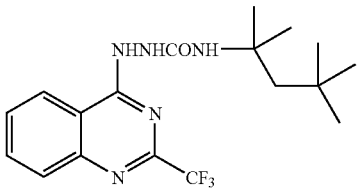

-continued (A-2)

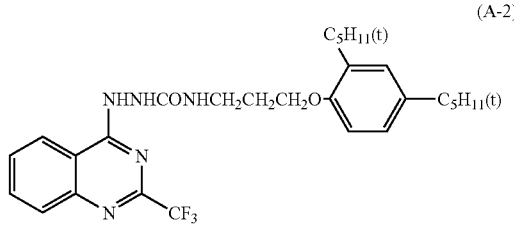

(A-3)

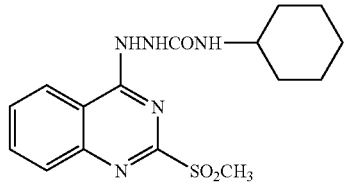

(A-4)

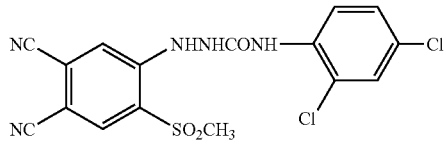

(A-5)

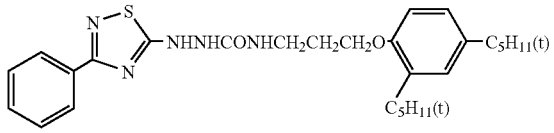

(A-6)

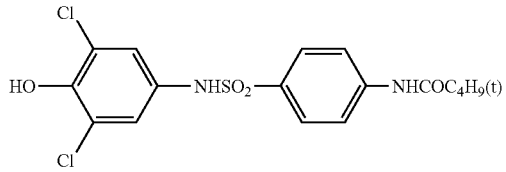

(A-7)

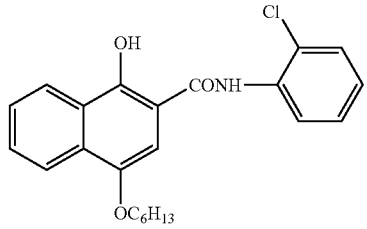

(A-8)

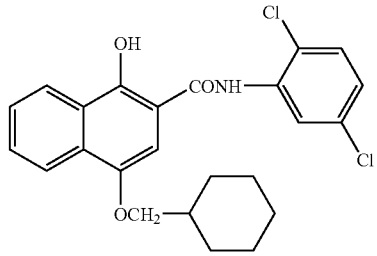

-continued (A-9)

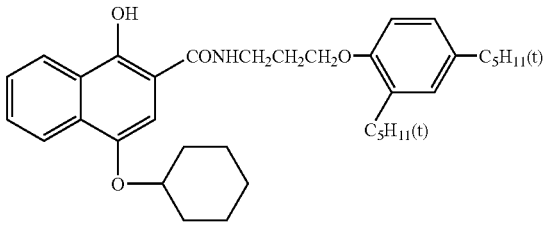

(A-10)

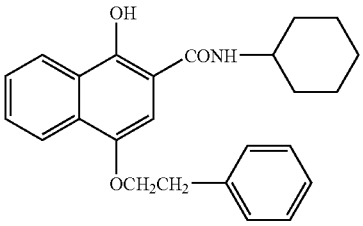

(A-11)

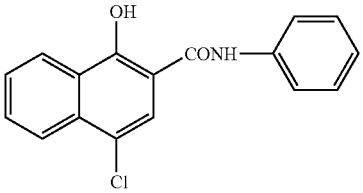

(A-12)

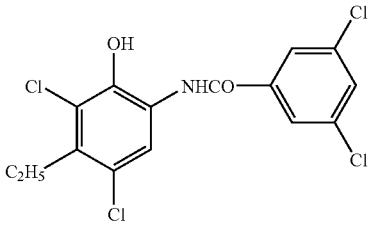

(Description of Hydrogen Bonding Compound)

In the invention, in the case where the reducing agent has an aromatic hydroxyl group (—OH) or an amino group (—NHR, R is a hydrogen atom or an alkyl group), particularly in the case where the reducing agent is a bisphenol described above, it is preferred to use a non-reducing compound having a group capable of reacting with these groups of the reducing agent, and that is also capable of forming a hydrogen bond in combination therewith.

As a group forming a hydrogen bond with a hydroxyl group or an amino group, there can be mentioned a phosphoryl group, a sulfoxide group, a sulfonyl group, a carbonyl group, an amide group, an ester group, an urethane group, an ureido group, a tertiary amino group, a nitrogen-containing aromatic group, and the like. Preferred among them is phosphoryl group, sulfoxide group, amide group (not having >N—H moiety but being blocked in the form of >N—Ra (where, Ra represents a substituent other than H)), urethane group (not having >N—H moiety but being blocked in the form of >N—Ra (where, Ra represents a substituent other than H)), and ureido group (not having >N—H moiety but being blocked in the form of >N—Ra (where, Ra represents a substituent other than H)).

In the invention, particularly preferable as the hydrogen bonding compound is the compound expressed by formula (D) shown below.

Formula (D)

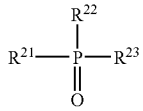

In formula (D), $R^{21}$ to $R^{23}$ each independently represent one selected from an alkyl group, an aryl group, an alkoxy group, an aryloxy group, an amino group, and a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., methyl group, ethyl group, isopropyl group, t-butyl group, t-octyl group, phenyl group, a 4-alkoxyphenyl group, a 4-acyloxyphenyl group, and the like.

Specific examples of an alkyl group expressed by $R^{21}$ to $R^{23}$ include methyl group, ethyl group, butyl group, octyl group, dodecyl group, isopropyl group, t-butyl group, t-amyl group, t-octyl group, cyclohexyl group, 1-methylcyclohexyl group, benzyl group, phenetyl group, 2 -phenoxypropyl group, and the like.

As an aryl group, there can be mentioned phenyl group, cresyl group, xylyl group, naphthyl group, 4-t-butylphenyl group, 4-t-octylphenyl group, 4-anisidyl group, 3,5-dichlorophenyl group, and the like.

As an alkoxyl group, there can be mentioned methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group, benzyloxy group, and the like.

As an aryloxy group, there can be mentioned phenoxy group, cresyloxy group, isopropylphenoxy group, 4-t-butylphenoxy group, naphthoxy group, biphenyloxy group, and the like.

As an amino group, there can be mentioned are dimethylamino group, diethylamino group, dibutylamino group, dioctylamino group, N-methyl-N-hexylamino group, dicyclohexylamino group, diphenylamino group, N-methyl-N-phenylamino, and the like.

Preferred as $R^{21}$ to $R^{23}$ are an alkyl group, an aryl group, an alkoxy group, and an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by formula (D) of the invention and others are shown below, but it should be understood that the invention is not limited thereto.

(D-1)
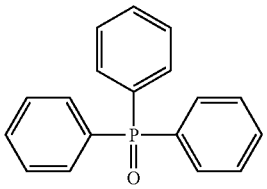
(D-2)
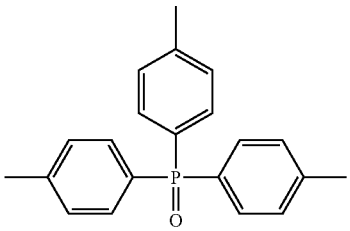
(D-3)
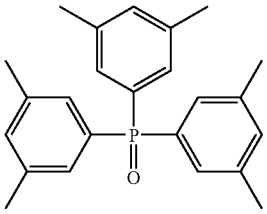
(D-4)
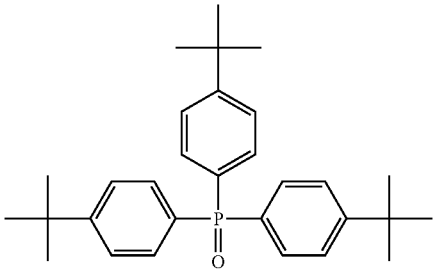
(D-5)
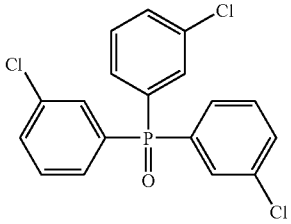
(D-6)
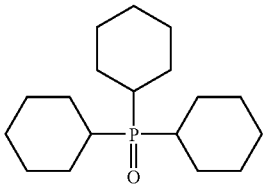
(D-7)
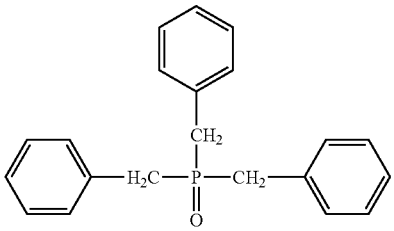
-continued
(D-8)
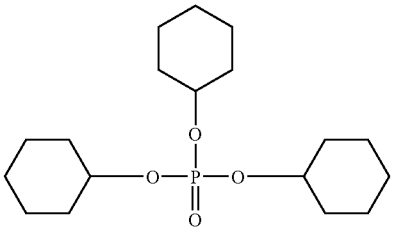
(D-9)
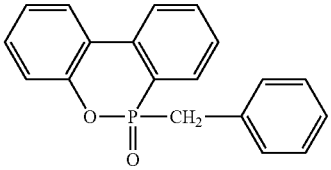
(D-10)
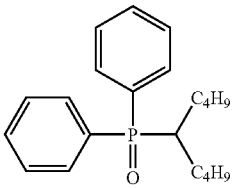
(D-11)
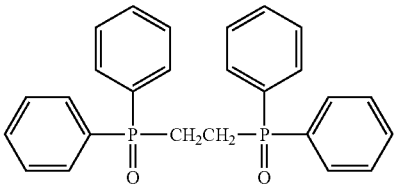
(D-12)
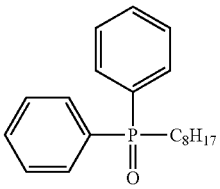
(D-13)
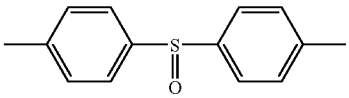
(D-14)
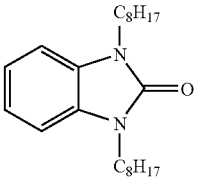
(D-15)
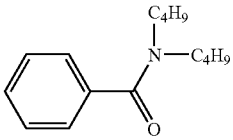
In addition to the above, specific examples of the hydrogen bonding compound include those desctibed in European Patent No. 1096310, and JP-A Nos. 2002-156727 and 2002-318431. The compound represented by formula (D) of the invention can be used in the photothermographic material by being incorporated into the coating solution in the form of solution, emulsion dispersion, or solid fine particle dispersion similar to the case of the reducing agent, but it is preferred to use as a solid dispersion. In the solution, the hydrogen bonding compound of the invention forms a hydrogen-bonded complex with a compound having a phenolic hydroxyl group, and can be isolated as a complex in crystalline state depending on the combination of the reducing agent and the compound expressed by formula (D).

It is particularly preferred to use the crystal powder thus isolated in the form of a solid fine particle dispersion, because it provides stable performance. Further, it is also preferred to use a method of leading to form complex during dispersion by mixing the reducing agent and the compound represented by formula (D) in the form of powders and dispersing them with a proper dispersing agent using a sand grinder mill and the like.

The compound represented by formula (D) of the invention is preferably used in the range from 1 mole % to 200 mole %, more preferably from 10 mole % to 150 mole %, and further preferably, from 20 mole % to 100 mole %, with respect to the reducing agent.

(Photosensitive Silver Halide)

1) Halide Composition

The photosensitive silver halide used in the present invention has a silver iodide content of 40 mole % or higher. Other components are not particularly limited and can be selected from silver halide such as silver chloride, silver bromide and the like, and organic silver salts such as silver thiocyanate, silver phosphate and the like, and particularly, silver bromide and silver chloride are preferable. By using such a silver halide having a high silver iodide content, a preferable photothermographic material having excellent image storability after developing process, particularly showing remarkably small increase in fogging in irradiation with light can be designed.

Further, it is preferable that the silver iodide content is 80 mole % to 100 mole %, more preferably from 90 mole % to 100 mole %, still more preferably 95 mole % to 100 mole %.

The distribution of the halogen composition in a grain may be uniform or the halogen composition may be changed stepwise, or it may be changed continuously. Further, a silver halide grain having a core/shell structure can be preferably used. Preferred structure is a twofold to fivefold structure and, more preferably, core/shell grain having a twofold to fourfold structure can be used. A core-high-silver iodide-structure which has a high content of silver iodide in the core part, or a shell-high-silver iodide-structure which has a high content of silver iodide in the shell part can also be preferably used.

Further, techniques that silver chloride or silver bromide is localized on the surface of grains as an epitaxial part can preferably used.

2) Grain Form

While examples of forms of silver halide grains in the invention are cubic grains, octahedral grains, dodecahedral grains, tetradecahedral grains, tabular grains, spherical grains, rod-like grains, potato-like grains and the like, particularly preferable in the invention are tabular grains, dodecahedral grains and tetradecahedral grains. The term "dodecahedral grain" means a grain having faces of (001), {1(−1)0} and {101} and the term "tetradecahedral grain" means a grain having faces of (001), {100} and {101}. The {100} expresses a family of crystallographic planes equivalent to a (100) face.

Silver iodide of the invention can assume any of a β phase or a γ phase contained. The term "β phase" described above means a high silver iodide structure having a wurtzite structure of a hexagonal system and the term "γ phase" means a high silver iodide structure having a zinc blend structure of a cubic crystal system.

An average content of γ phase in the present invention is determined by a method presented by C. R. Berry. In the method, an average content of γ phase is calculated from the peak ratio of the intensity owing to γ phase (111) to that owing to β phase (100), (101), 002) in powder X ray diffraction method. Detail description, for example, is described in Physical Review, volume 161, No. 3, p. 848 to 851 (1967).

According to the method of forming tabular grains of silver iodide, preferably used are those described in JP-A Nos. 59-119350 and 59-119344. As for forming dodecahedral grains, tetradecahedral grains and octahedral grains, the methods described in JP-A Nos._2002-081020, 2003-287835, and 2003-287836 can be used for reference.

The silver halide having a high silver iodide content of the invention can take a complicated form, and as the preferable form, there are listed, for example, connecting grains as shown in R. L. JENKINS et al., J. Phot. Sci. Vol. 28 (1980), p164, FIG. 1. Flat plate particles as shown in FIG. 1 of the same literature can also be preferably used. Grains obtained by rounding corners of silver halide grains can also be preferably used. The surface index (Miller index) of the outer surface of a photosensitive silver halide particle is not particularly restricted, and it is preferable that the ratio occupied by the [100] surface is rich, because of showing high spectral sensitization efficiency when a spectral sensitizer is adsorbed. The ratio is preferably 50% or more, more preferably 65% or more, further preferably 80% or more. The ratio of the [100] surface, Miller index, can be determined by a method described in T. Tani; J. Imaging Sci., 29, 165 (1985) utilizing adsorption dependency of the [111] surface and [100] surface in adsorption of a sensitizing dye.

3) Grain Size

The photosensitive silver halide grains are preferably sufficiently small compared with conventional silver bromide or low-iodide content silver iodobromide. The mean grain size of the silver halide is preferably 5 nm to 70 nm, more preferably 5 nm to 55 nm, particularly preferably 10 nm to 45 nm. The term "grain size" used here means an average diameter of a circle having the same area as the projected area observed through an electron microscope.

The silver halide grains used in the invention may preferably be tabular grains.

4) Method of Grain Formation

The method of forming photosensitive silver halide is well-known in the relevant art and, for example, methods described in Research Disclosure No. 10729, June 1978, and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

To produce the tabular grains of silver iodide, methods described in the above-mensioned JP-A Nos. 59-119350 and 59-119344 are preferably used.

In the present invention, a silver halide grain having a hexacyano metal complex that is present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, [Ir (CN)

Since the hexacyano complex exists in ionic form in an aqueous solution, counter cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra (n-butyl) ammonium ion), which are easily misible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters and amides) or gelatin.

The addition amount of the hexacyano metal complex is preferably from $1\times10^{-5}$ mole to $1\times10^{-2}$ mole per 1 mole of silver, and more preferably from $10\times10^{-4}$ mole to $1\times10^{-3}$.

In order to make the hexacyano metal complex be present on the outermost surface of a silver halide grain, the hexacyano metal complex is directly added in any of the following stages: after completion of addition of an aqueous solution of silver nitrate used for grain formation; before completion of an emulsion formation step prior to a chemical sensitization step, of conducting chalcogen sensitization such as sulfur sensitization, selenium sensitization and tellurium sensitization or noble metal sensitization such as gold sensitization; during washing; during dispersing; or immediately before chemical sensitization. In order not to grow the fine silver halide grains, the hexacyano metal complex is preferably rapidly added after the grain is formed, and it is preferably added before completion of the emulsion formation step.

Addition of the hexacyano complex may be started after addition of 96% by mass of an entire amount of silver nitrate to be added for grain formation, more preferably started after addition of 98% by mass and, particularly preferably, started after addition of 99% by mass.

When any of the hexacyano metal complex is added after addition of an aqueous silver nitrate just before completion of grain formation, it can be adsorbed to the outermost surface of the silver halide grain and most of them form an insoluble salt with silver ions on the surface of the grain. Since silver hexacyanoferrate (II) is a less soluble salt than AgI, re-dissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No.11-84574, in paragraph Nos. 0025 to 0031 of JP-A No.11-65021, and paragraph Nos. 0242 to 0250 of JP-A No.11-119374.

6) Gelatin

As the gelatin contained the photosensitive silver halide emulsion used in the invention, various kinds of gelatins can be used. It is necessary to maintain an excellent dispersion state of a photosensitive silver halide emulsion in an organic silver salt containing coating solution, and low molecular weight gelatin having a molecular weight of 10,000 to 100,000 is preferably used. Further, phthalated gelatin in which substituents in gelatin are substituted with phthalic groups is also preferably used. These gelatins may be used at grain formation or at the time of dispersion after desalting treatment and they are preferably used during grain formation.

7) Chemical Sensitization

The photosensitive silver halide grain in the invention is preferably chemically sensitized by sulfur sensitizing method, selenium sensitizing method or tellurium sensitizing method. As the compound used preferably for sulfur sensitizing method, selenium sensitizing method and tellurium sensitizing method, known compounds, for example, compounds described in JP-A No. 7-128768 can be used. Particularly, tellurium sensitization is preferred in the invention and compounds described in the literature cited in paragraph No. 0030 in JP-A No. 11-65021 and compounds shown by formulae (II), (III), and (IV) in JP-A No. 5-313284 are more preferred.

The photosensitive silver halide particles of the present invention is chemically sensitized by gold sensitization independently, or sensitized by gold sensitization in combination with the above chalcogen sensitization. As the gold sensitizer, Au(II) or Au(III) are preferred, and gold compounds which are generally uses as gold sensitizers are preferably used.

Typical examples of gold sensitizers include chloroauric acid, bromoauric acid, potassium chloroaurate, potassium bromoaurate, auric trichloride, potassium aurithiocyanate, potassium iodoaurate, tetracyanoauric acid, ammonium aurothiocyanate, pyridiltrichloro gold and the like. Further, gold sensitizers described in U.S. Pat. No. 5,858,637 and JP-A No. 2002-278016 are preferably used.

In the invention, the chemical sensitization can be carried out at any time as long as it is after grain formation and before coating, and it can be applied, after desalting, (1) before spectral sensitization, (2) simultaneously with spectral sensitization, (3) after spectral sensitization and (4) just before coating.

The addition amount of sulfur, selenium or tellurium sensitizer used in the present invention may vary depending on the silver halide grain used, the chemical ripening condition and the like, and it is about $10^{-8}$ mole to $10^{-2}$ mole, and preferably, about $10^{-7}$ mole to $10^{-3}$ mole, per 1 mole of silver halide.

Similarly, the addition amount of the gold sensitizer used in the invention may vary depending on various conditions and it is generally about $10^{-7}$ mole to $10^{-3}$ mole and, more preferably, $10^{-6}$ mole to $5\times10^{-4}$ mole per 1 mole of silver halide. There is no particular restriction on the condition for the chemical sensitization in the invention and, appropriately, the pH is about 5 to about 8, the pAg is about 6 to about 11, and the temperature is about 40° C. to about 95° C.

Thiosulfonic acid compounds may be added to the silver halide emulsion used in the present invention according to the method described in European Patent No. 293,971.

A reduction senstitizer is used preferably for the photosensitive silver halide grain in the invention. As the specific compound for the reduction sensitization, ascorbic acid or amino imino methane sulfinic acid is preferred, as well as use of stannous chloride, hydrazine derivatives, borane compounds, silane compounds and polyamine compounds are preferred. The reduction sensitizer may be added at any stage in the photosensitive emulsion production process from crystal growth to the preparation step just before coating. Further, it is preferred to apply reduction sensitization by ripening while keeping pH to 7 or higher or pAg to 8.3 or lower for the emulsion, and it is also preferred to apply reduction sensitization by introducing a single addition portion of silver ions during grain formation.

8) Combined Use of a Plurality of Silver Halides

The photosensitive silver halide emulsion in the photothermographic material used in the invention may be used alone as one kind, or two or more kinds of them (for example, those of different average particle sizes, different halogen compositions, of different crystal habits and of different conditions for chemical sensitization) may be used together. Gradation can be controlled by using plural kinds of photosensitive silver halide of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

9) Coating Amount

The addition amount of the photosensitive silver halide, when expressed by the amount of coated silver per 1 $m^2$ of the photothermographic material, is preferably from 0.03 $g/m^2$ to 0.6 $g/m^2$, more preferably, from 0.05 $g/m^2$ to 0.4 $g/m^2$ and, further preferably, from 0.07 $g/m^2$ to 0.3 $g/m^2$. The photosensitive silver halide is used in the range from 0.01 mol to 0.5 mol, preferably, from 0.02 mol to 0.3 mol, and further preferably from 0.03 mol to 0.2 mol, per 1 mol of the organic silver salt.

10) Mixing Silver Halide and Organic Silver Salt

The method of mixing the silver halide and the organic silver salt can include a method of mixing a separately prepared photosensitive silver halide and an organic silver salt by using a high speed stirrer, ball mill, sand mill, colloid mill, vibration mill, or homogenizer, or a method of mixing a separately prepared photosensitive silver halide at any timing in the preparation of an organic silver salt and preparing the organic silver salt. Any of the methods described above can be used so long as the effects of the present inventin are exerted.

11) Mixing Silver Halide into the Coating Solution

In the invention, the time of adding silver halide to the coating solution for the image forming layer is preferably in the range from 180 minutes before to just prior to the coating, more preferably, 60 minutes before to 10 seconds before coating. But there is no particular restriction on the mixing method and mixing conditions as long as the effect of the invention is sufficiently shown. As an embodiment of a mixing method, there is a method of mixing in a tank controlling the average residence time to the desired value. The average residence time herein is calculated from the addition flow volume and the amount of solution being transferred to the coater. And another embodiment of mixing method is a method using a static mixer, which is described in 8th edition of "Ekitai Kongo Gijutu" by N. Harnby and M. F. Edwards, translated by Koji Takahashi (Nikkan Kogyo Shinbunshakan, 1989).

(Binder)

Any kind of polymer may be used as the binder for the image forming layer in the photothermographic material of the invention as long as it is hydrophilic. Suitable binders are those that are transparent or translucent, and are generally colorless such as: natural resins or polymers and their copolymers; synthetic resins or polymers and their copolymers; or film forming media including, for example, gelatins, rubbers, poly(vinyl alcohols), hydroxyethyl celluloses, cellulose acetates, poly(vinyl pyrrolidones), caseins, starches, poly(acrylic acids) and poly(methylmethacrylic acids).

In the invention, a hydrophilic binder content that is usable in combination with the binder in the layer containing the organic silver salt is preferably in the range from 50% by mass to 100% by mass, and particularly preferably in the range from 70% by mass to 100% by mass.

Examples of the hydrophilic binder includes gelatin and gelatin derivatives (alkali-processd gelatins or acid-processed gelatins, acetilated gelatin, oxidized gelatin, phthalated gelatin and deionized gelatin), polysilic acid, acrylamide/methacrylamide polymer, acryl/methacryl polymer, polyvinyl pyrolidones, poly vinyl acetates, poly vinyl alcohols, poly vinyl lactams, a polymer of sulfoalkyl acrylate and methacrylate, hydrolyzed poly vinyl acetate, polysaccharides (for example, dextrans and starch ethers), and other synthetic or natural vehicles that are essentially hydrophilic (as defined above) (for example, see Research Disclosure, item 38957), however, these examples are not intended to limit the invention. Among them, gelatin and gelatin derivatives as well as poly vinyl alcohols are more preferable, and gelatin and gelatin derivatives are most preferable.

In the invention, it is preferred that the image forming layer is formed by applying a coating solution containing 30% by mass or more of water in the solvent followed by drying, more preferably a coating solution containing 50% by mass or more of water.

The aqueous solvent in which the polymer is soluble or dispersible, as referred to herein, signifies water or water containing mixed therein 70% by weight or less of a water miscible organic solvent. As water miscible organic solvents, there can be mentioned, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

Binders usable other than the hydrophilic binders preferably include polymers which are dispersible in an aqueous solvent. Preferred embodiments of such polymers includes hydrophobic polymers such as acrylic polymers, poly(esters), rubbers (e.g., SBR resin), poly(urethanes), poly(vinyl chlorides), poly(vinyl acetates), poly(vinylidene chlorides), poly(olefins), and the like. As the polymers above, usable are straight chain polymers, branched polymers, or cross-linked polymers; also usable are the so-called homopolymers in which a single monomer is polymerized, or copolymers in which two or more types of monomers are polymerized. In the case of a copolymer, it may be a random copolymer or a block copolymer. The molecular weight of these polymers is, in number average molecular weight, in the range from 5,000 to 1,000,000, preferably from 10,000 to 200,000. Those having too small molecular weight exhibit insufficient mechanical strength on forming the image forming layer, and those having too large molecular weight are not preferred either, because the film forming properties are poor. Further, cross-linkable polymer latexes are particularly preferred for use.

A binder content in the layer containing the organic silver salt (i.e., the image forming layer) in the invention in terms of a ratio by mass of the organic silver salt/the whole binder is 1/10 to 10/1, more preferably in the range from 0.6 to 3.0, and even more preferably in a range from 1.0 to 2.5.

A total binder content in the image forming layer in the invention is preferably in the range from 0.2 $g/m^2$ to 30 $g/m^2$, more preferably in the range from 1 $g/m^2$ to 15 $g/m^2$, and even more preferably in the range from 2 $g/m^2$ to 10 g/m$^2$. The image forming layer in the invention may further contain a cross-linkable agent for ccross-linking, a surfactant for improving coating property, and the like.

(Preferable Solvent for Coating Solution)

In the invention, a solvent for use in the coating solution for forming the image forming layer in the photothermographic material (here, for simplicity, solvents and dispersion media are collectively called as solvents) is preferably an aqueous solvent containing 30% by mass or more of water. As a component other than water, any of water miscible organic solvents may be used such as methyl alcohol, ethyl alcohol, isopropyl alcohol, methyl cellosolve, ethyl cellosolve, dimethyl formamide, and ethyl acetate. A water content in the solvent for use in the coating solution is not less than 50% by mass, and more preferably not less than 70% by mass. Examples of preferable solvent compositions besides water include water/methyl alcohol=90/10, water/methyl alcohol=70/30, water/methyl alcohol/dimethyl formamide=80/15/5, water/methyl alcohol/ethyl cellosolve=85/10/5, water/methyl alcohol/isopropyl alcohol=85/10/5, and the like (a unit for the numerical values is "% by mass").

(Antifoggant)

As an antifoggant, stabilizer and stabilizer precursor usable in the invention, there can be mentioned those disclosed in paragraph number 0070 of JP-A No. 10-62899 and in line 57 of page 20 to line 7 of page 21 of EP-A No. 0803764A1, the compounds described in JP-A Nos. 9-281637 and 9-329864, in U.S. Pat. No. 6,083,681, and in European Patent No. 1048975.

1) Organic Polyhalogen Compound

Organic polyhalogen compounds preferably used in the invention will be described in detail below. The polyhalogen compounds in the present invention are preferably expressed by formula (H) below:

$$Q—(Y)n—C(X_1)(X_2)Z \qquad \text{Formula (H)}$$

In formula (H), Q represents an alkyl group, an aryl group or a heterocyclic group; Y represents a divalent linking group; n represents 0 or 1; and Z represents a halogen atom; and $X_1$ and $X_2$ each represent a hydrogen atom or an electron-attracting group.

In formula (H), Q is preferably an alkyl group having 1 to 6 carbon atoms, an aryl group having 6 to 12 carbon atoms or a heterocyclic group such as pyridine group and quinoline group containing at least one nitrogen atom, In formula (H), in the case where Q is an aryl group, Q preferably is a phenyl group substituted by an electron-attracting group whose Hammett substituent constant σp assumes a positive value. For the details of Hammett substituent constant, reference can be made to Journal of Medicinal Chemistry, vol. 16, No. 11 (1973), pp. 1207 to 1216, and the like. As such electron-attracting groups, examples include, a halogen atom, an alkyl group substituted with an electron-attracting group, an aryl group substituted with an electron-attracting group, a heterocyclic group, an alkyl sulfonyl group or an aryl sulfonyl group, an acyl group, an alkoxycarbonyl group, a carbamoyl group and sulfamoyl group. Preferable electron-attracting groups include a halogen atom, group, a carbamoyl group and an aryl sulfonyl group. Particularly preferable group is a carbamoyl group.

At least one of $X_1$ and $X_2$ preferably is an electron-attracting group, more preferably, one selected from a halogen atom, an aliphatic sulfonyl group, an aryl sulfonyl group, a heterocyclic sulfonyl group, an aliphatic acyl group, an aryl acyl group, a heterocyclic acyl group, an aliphatic oxycarbonyl group, an aryl oxycarbonyl group, a heterocyclic oxycarbonyl group, carbamoyl group, and sulfamoyl group; A halogen atom and a carbamoyl group are particularly preferred. Among them, a bromine atom is particularly preferred.

Z is preferably a bromine atom or an iodine atom, more preferably a bromine atom. Y preferably represents —C(═O)—, —SO—, —$SO_2$—, —C(═O)N(R)— or —$SO_2$N(R)—; more preferably, —C(═O)—, —$SO_2$— or —C(═O)N(R)—; and particularly preferred is —$SO_2$— or —C(═O)N(R)—. Here, R is a hydrogen atom, an aryl group or an alkyl group, more preferably, a hydrogen atom or an alkyl groyp, particularly preferably a hydrogen atom. n represents 0 or 1, and preferably 1.

In formula (H), when Q represents an alkyl group, Y preferably represents —C(═O)N(R)—, and when Q represents an aryl group or a heterocyclic group, Y preferably represents —$SO_2$—.

In formula (H), formations where moieties after the hydrogen atom is removed from the compound are bonded to each other (generally referred to as bis-type, tris-type, or tetrakis-type) can also be used preferably.

In formula (H), formations where the substituent is a dissociating group (for example, COOH or a salt thereof, $SO_3H$ or a salt thereof, $PO_3H$ or a salt thereof), a group having a quaternary nitrogen cation (for example, an ammonium group, a pyridinium group), a polyethyleneoxy group, a hydroxyll group, or the like are also preferable.

Specific examples of the compounds of the invention shown by the formula (H) will be described below.

(H-1)

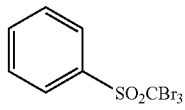

(H-2)

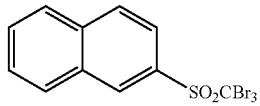

(H-3)

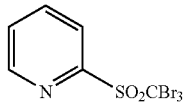

(H-4)

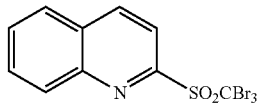

(H-5)

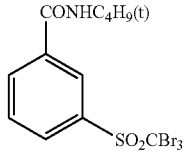

-continued (H-6)

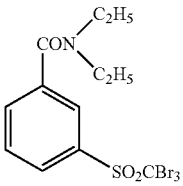

(H-7)

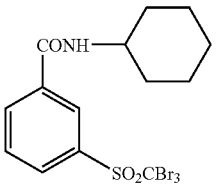

(H-8)

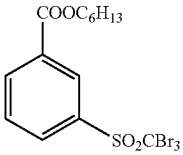

(H-9)

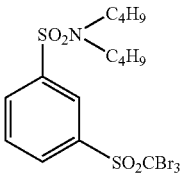

(H-10)

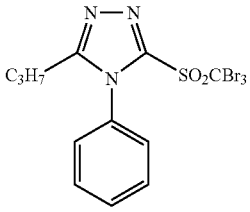

(H-11)

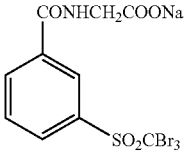

(H-12)

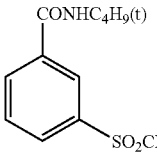

(H-13)

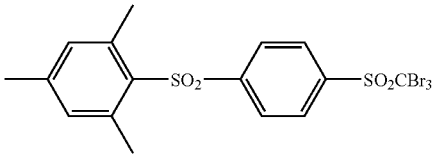

(H-14)

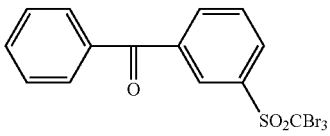

-continued (H-15)

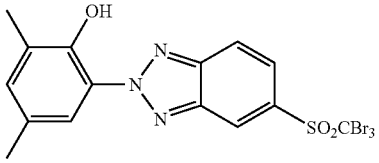

(H-16)

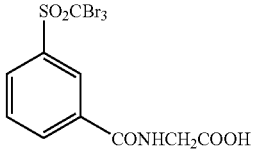

(H-17)

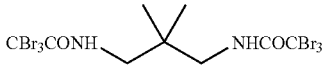

(H-18)

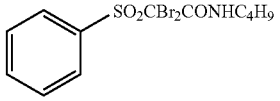

(H-19)

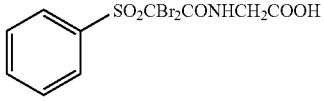

(H-20)

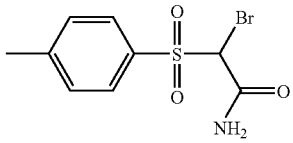

(H-21)

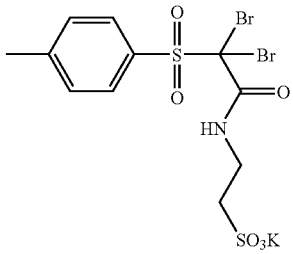

Polyhalogen compounds other than the above compounds include exemplified compounfd described in U.S. Pat. Nos. 3,874,946, 4,756,999, 5,340,712, 5,369,000, 5,464,737, 6,506,548, JP-A No. 50-137126, 50-89020, 50-119624, 59-57234, 7-2781, 7-5621, 9-160164, 9-244177, 9-244178, 9-160167, 9-319022, 9-258367, 9-2651509-319022, 10-197988, 10-197989, 11-242304, 2000-2963, 2000-112070, 2000-284410, 2000-284412, 2001-33911, 2001-31644, 2001-312027 and 2003-50441 are preferably used.

As preferred polyhalogen compounds of the invention other than those above, there can be mentioned compounds disclosed in JP-A Nos. 7-2781, 2001-33911, and 2001312017.

The compounds expressed by formula (H) of the invention are preferably used in an amount from $10^{-4}$ mole to 1 mole, more preferably, $10^{-3}$ mole to 0.5 mole, and further preferably, $1\times10^{-2}$ mole to 0.2 mole, per 1 mole of non-photosensitive silver salt incorporated in the image forming layer.

In the invention, usable methods for incorporating the anti-fogging agent expressed by formula (H) into the photosensitive material are those described above in the method for incorporating the reducing agent, and similarly, for the organic polyhalogen compound, it is preferably added in the form of a solid fine particle dispersion.

2) Other Antifoggants

As other antifoggants, there can be mentioned a mercury (II) salt described in paragraph number 0113 of JP-A No. 1'-65021, benzoic acids described in paragraph number 0114 of the same literature, a salicylic acid derivative described in JP-A No. 2000-206642, a formaline scavenger compound expressed by formula (S) in JP-A No. 2000-221634, a triazine compound related to claim 9 of JP-A No. 11-352624, a compound expressed by formula (III), 4-hydroxy-6-methyl-1,3,3a,7-tetrazaindene and the like, as described in JP-A No. 6-11791.

The photothermographic material of the invention may further contain an azolium salt in order to prevent fogging. As azolium salts, there can be mentioned compounds expressed by formula (XI) as described in JP-A No. 59-193447, a compound described in JP-B No. 55-12581, and a compound expressed by formula (II) in JP-A No. 60-153039. The azolium salt may be added to any part of the photosensitive material, but as the addition layer, preferred is to select a layer on the side having thereon the image forming layer, and more preferred is to select the image forming layer. The azolium salt may be added at any time of the process of preparing the coating solution; in the case the azolium salt is added into the image forming layer, any time of the process may be selected, from the preparation of the organic silver salt to the preparation of the coating solution, but preferred is to add the salt after preparing the organic silver salt and just before the coating. As the method for adding the azolium salt, any method using a powder, a solution, a fine-particle dispersion, and the like, may be used.

Furthermore, it may be added as a solution having mixed therein other additives such as sensitizing agents, reducing agents, color tone controlling agents, and the like. In the invention, the azolium salt may be added at any amount, but preferably, it is added in the range of from $1\times10^{-6}$ mol to 2 mol, and more preferably, from $1\times10^{-3}$ mol to 0.5 mol per 1 mol of silver.

(Explanation of Compound Represented by Formula (I) or (II))

Formula (I)

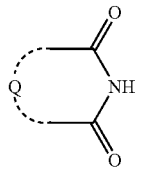

Formula (II)

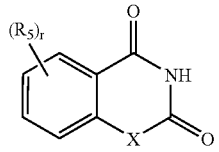

In formula (I) Q represents an atomic group necessary for forming a 5 or 6 member imide ring. In formula (II) $R_5$ independently represent one or more of a hydrogen atom, an alkyl group, a cycloalkyl group, an alkoxy group, an alkylthio group, a n arylthio group, a hydroxyl group, a halogen atom, or $N(R_8R_9)$ group, or the necessary atomic groups so that two $R_5$ groups can be linked together to form an aromatic, hetero aromatic, alicyclic ring or hetero cyclic condensation ring. Here $R_8$ and $R_9$ each independently represent a hydrogen atom, an alkyl group, an aryl group, a cycloalkyl group, an alkenyl group or a hetero ring or the necessary atomic groups so that $R_8$ and $R_9$ can be linked together to form a substituted or unsubstituted 5 to 7 member hetero ring. X represents O, S, Se or $N(R_6)$, were $R_6$ is a hydrogen atom, alkyl group, aryl group, cycloalkyl group, alkenyl group or heterocyclic group and r is 0, 1 or 2.

1) Explanation of Formula (I)

A nitrogen atom and a carbon atom forming Q may have a hydrogen atom, amino group, alkyl group having 1 to 4 carbon atoms, halogen atom, keto-oxygen atom, aryl group, or the like bonded thereto as a branch. Specific examples of the compound having the imide ring represented by formula (I) include uracil, 5-bromouracil, 4-methyluracil, 5-methyluracil, 4-carboxyuracil, 4,5-dimethyluracil, 5-aminouracil, dihydrouracil, 1-ethyl-6-methyluracil, 5-carboxymethylaminouracil, barbituric acid, 5-phenylbarbituric acid, cyanuric acid, urasol, hydantoin, 5,5-dimethyl hydantoin, glutarimide, glutaconimide, citrazinic acid, succinimide, 3,4-dimethylsuccinimide, maleimide, phthalimide, and naphthalimide, however these examples are not intended to limit the invention. In the invention, among the compounds having the imide ring represented by formula (I), succinimide, phthalimide, naphthalimide, and 3,4-dimethylsuccinimide are preferable, and succinimide is particularly preferable.

2) Explanation of Formula (II)

In formula (II) $R_5$ independently represent one or more of a hydrogen atom, an alkyl group, a cycloalkyl group, an alkoxy group, an alkylthio group, a n arylthio group, a hydroxyl group, a halogen atom, or $N(R_8R_9)$ group. Further, it can represent the necessary atomic groups so that two $R_5$ groups can be linked together to form an aromatic, hetero aromatic, alicyclic ring or hetero cyclic condensation ring. When $R_5$ represents an amino group $[N(R_8R_9)]$, $R_8$ and $R_9$ each independently represent a hydrogen atom, an alkyl group, an aryl group, a cycloalkyl group, an alkenyl group or a hetero ring. Further, then can represent the necessary atomic groups so that $R_8$ and $R_9$ can be linked together to form a substituted or unsubstituted 5 to 7 member hetero ring. In formula (II) X represents O, S, Se or $N(R_6)$, were $R_6$ represents a hydrogen atom, alkyl group, aryl group, cycloalkyl group, alkenyl group or heterocyclic group. r is 0, 1 or 2.

Alkyl groups preferable as $R_5$, $R_6$, $R_8$ and $R_9$ are linear, branched or cyclic alkyl groups, and can have 1 to 20 carbon atoms, preferably have 1 to 5 carbon atoms. Alkyl groups having 1 to 4 carbon atoms (for example, methyl, ethyl, iso-propyl, n-butyl, t-butyl and sec-butyl) are particularly preferable.

Usable aryl groups for $R_5$, $R_6$, $R_8$ and $R_9$ are aromatic rings (singular or multiple) with 6 to 14 carbon atoms therein. Preferable aryl groups are phenyl groups or substituted phenyl groups.

Usable cycloalkyl groups for $R_5$, $R_6$, $R_8$ and $R_9$ can have 5 to 14 carbon atoms in the central ring system. Preferable cycloalkyl groups are cyclopentyl or cyclohexyl.

Preferable alkenyl groups and alkinyl groups may be branched or linear, and have 2 to 20 carbon atoms. A preferable alkenyl group is an allyl group.

Heterocyclic groups preferable as $R_5$, $R_6$, $R_8$ and $R_9$ can have 5 to 10 carbon, oxygen, sulfur and nitrogen atoms in the central ring system thereof, and may have a condensed ring.

These alkyl, aryl, cycloalkyl and heterocyclic groups, although not limited to, may further be substituted by one or more groups including a halo group, alkoxy carbonyl group, hydroxyl group, alkoxy group, cyano group, acyl group, acyloxy group, carbonyloxy ester group, sulfonate group, alkylthio group, dialkylamino group, carboxyl group, sulfo group, phosphono group, and other groups that can easily be listed by those skilled in the art.

As alkoxy, alkylthio, and arylthio groups for $R_5$ can be used the alkyl and aryl groups which have been listed above. Preferable halogen groups are chloro and bromo. Typical compounds represented by the formula (II) are the compounds II-1 to II-10 listed below. The compound II-1 is particularly preferable.

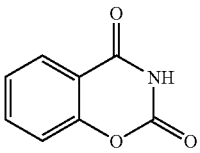

(II-1)

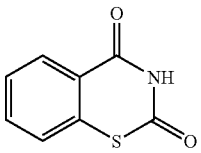

(II-2)

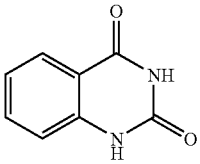

(II-3)

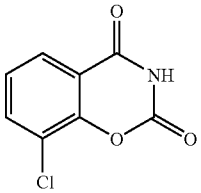

(II-4)

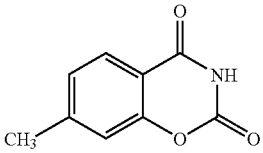

(II-5)

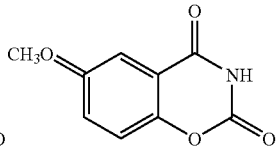

(II-6)

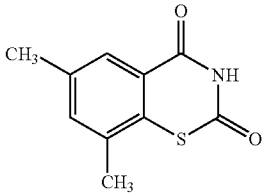

(II-7)

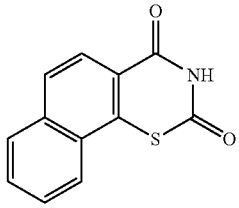

(II-8)

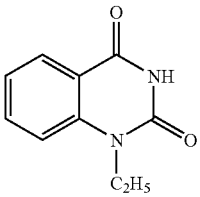

(II-9)

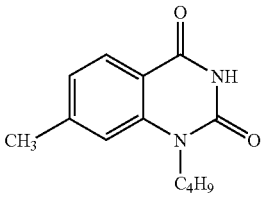

(II-10)

Other preferable substituted benzoxazine diones are described in U.S. Pat. No. 3,951,660 (Hagemann, et al.). These compounds represented by formulae (I) and (II) are preferably used as co; or toning agents. Examples of toning agents for use in combination with the compounds represented by formulae (I) and (II) include: phthalazinone and phthalazinone derivatives or metal salts of the derivatives, such as 4-(1-naphthyl)phthalazinone, 6-chlorophthalazinone, 5,7-dimethoxyphthalazinone, and 2,3-dihydro-1,4-phthalazine dione; phthalazine and phthalazine derivatives (such as 5 isopropyl phthalazine), phthalic acid derivatives (such as phthalic acid, 4-methylphthalic acid, 4-nitrophthalic acid, tetrachlorophthalic acid).

An amount to be added of the compound represented by formula (I) or (II) of the invention per 1 mole of non-photosensitive silver halide in the image forming layer is preferably in the ange from $10^{-4}$ mole to 1 mole, more preferably in the range from $10^{-3}$ mole to 0.5 mole, and even more preferably in the range from $1\times10^{-2}$ mole to 0.3 mole.

The compound represented by formula (I) or (II) of the invention can be added to the photothermographic material by the methods described above with respect to the reducing agent. If the compound is water-soluble, it is preferable to add the compound in the form of solution. In contrast, if the compound is not water-soluble, it is preferable to add the compound in the form of a solid particle dispersion.

The compound represented by formula (I) or (II) of the invention is preferably added to the image forming layer or a layer adjacent to the image forming layer such as a protective layer or an intermediate layer, and particularly preferably to the image forming layer.

3) Plasticizer and Lubricant

In the invention, a plasticizer or a lubricant already known may be used in order to improve physical properties of a layer. It is particularly preferable to employ a lubricant such as liquid paraffin, a long-chain fatty acid, a fatty acid amide or a fatty acid ester in order to improve a handling property at the manufacture or a scratch resistance at the thermal development. There is particularly preferred liquid paraffin from which low-boiling components are removed or a fatty acid ester of a branched structure having a molecular weight of 1,000 or higher.

A plasticizer and a lubricant which can be used in an image forming layer or a non-image froming layer of the invention are described in JP-A Nos. 1-65021, paragraph 0117, and 2000-5137, and Japanese Patent Applications Nos. 2003-8015, 2003-8071 and 2003-132815.

4) Dye, Pigment

In the photosensitive layer of the invention, for the purposes of color tone improvement, prevention of interference fringes at the laser exposure and prevention of irradiation, there may be employed various dyes or pigments (for example C. I. Pigment Blue 60, C. I. Pigment Blue 64, or C. I. Pigment Blue 15:6). These are described in detail for example in WO98/36322, and JP-A Nos. 10-268465 and 11-338098.

5) Nucleation Agent

In the photothermographic material of the present invention, it is preferable to add a nucleation agent in the image forming layer. The nucleation agent, a method of addition thereof and an amount of addition thereof are described for example in JP-A No. 11-65021, paragraph 0118, in JP-A No. 11-223898, paragraphs 0136–0193, in JP-A No. 2000-284399, formulas (H), (1) to (3), (A) and (B), and in JP-A No. 2000-347345, compound represented by formulas (III) to (V) (specific compounds in formulas 21–24). Nucleation accelerating agents are described in JP-A No. 11-65021, paragraph 0102 and in JP-A No. 11-223898, paragraphs 0194–0195.

In order to employ formic acid or a formate salt as a strong fogging substance, it is preferably added on the side having the image forming layer and containing photosensitive silver halide, and included in an amount of 5 mmol or less per 1 mole of silver, more preferably 1 mmol or less.

In the photothermographic material of the invention, when a nucleation agent is used, it is preferable that is used together with acids which can be formed by hydration of diphosphorus pentoxide, or salts thereof. As acids or salts which can be formed by hydration of diphosphorus pentoxide there are the examples of metaphosphoric acid (salts), pyrophosphoric acid (salts), orthophosphoric acid (salts), triphosphoric acid (salts), tetraphosphoric acid (salts), and hexametaphosphoric acid (salts). Particularly preferably used acids formed by hydration of diphosphorus pentoxide or salts thereof are orthophosphoric acid (salts) and hexametaphosphoric acid (salts). Specific examples of the salts are sodium orthophosphate, sodium dihydrogenorthophosphate, sodium hexametaphosphate, ammonium hexametaphosphate and the like. Acids formed by hydration of diphosphorus pentoxide or salts thereof may be used in a desired amount (coating amount per $m^2$ of the photosensitive material) depending on the desired performance including sensitivity and fogging. However, it can be used in an amount of preferably 0.1 to 500 $mg/m^2$, more preferably 0.5 to 100 $mg/m^2$.

It is preferable to use the reducing agent, hydrogen bonding compound, development promoting agent and polyhalogen compounds of the invention in the form of solid dispersions. Preferable methods of manufacturing these solid dispersions are disclosed in JP-A No. 2002-55405.

(Preparation of Coating Solution and Coating)

The temperature for preparing the coating solution for the image forming layer of the invention is preferably from 30° C. to 65° C., more preferably, from 35° C. or more to less than 60° C., and further preferably, from 35° C. to 55° C. Furthermore, the temperature of the coating solution for the image forming layer immediately after adding the polymer latex is preferably maintained in the temperature range from 30° C. to 65° C.

(Structure of Layer and Components Thereof)

The image forming layer in the invention is formed by one or more layers on a support. When the image forming layer is formed by a single layer, the layer contains the organic silver salt, the photosensitive silver halide, the reducing agent and the binder, and may further contain additional materials such as a toning agent, a coating aid and other auxiliaries, as required. When the image forming layer is formed by two or more layers, a first image forming layer thereof (usually a layer adjacent to the support) contains the organic silver salt and the photosensitive silver halide, and a second image forming layer or the both of the layers have to contain other components. A multicolor photothermographic material may include a combination of these two layers for each color. Further, as described in U.S. Pat. No. 4,708,928, all the components may be contained in a single layer. In a case of a multi-dye multicolor photothermographic material, generally, as described in U.S. Pat. No. 4,460,681, image forming layers are separated from each other by a functional or non-functional barrier layer disposed therebetween.

The photothermographic material of the invention can have a non-photosensitive layer, in addtion to the image forming layer. The non-photosensitive layer can be classified, based on a position thereof, into (a) a surface protective layer disposed on the image forming layer (at a side farther from (opposite to) the support), (b) an intermediate layer disposed between the image forming layers or between the image forming layer and a protective layer, (c) an undercoat layer disposed between the image forming layer and the support, and (d) a back layer disposed at a side of the support opposite to the image forming layer.

Further, a layer serving as an optical filter can be provided as the layer (a) or (b) above. An anti-halation layer is provided as the layer (c) or (d) in the photothermographic material.

1) Surface Protective Layer

The photothermographic material of the invention may further comprise a surface protective layer with an object to prevent adhesion of the image forming layer. The surface protective layer may be a single layer, or plural layers.

Description on the surface protective layer may be found in paragraph Nos. 0119 to 0120 of JP-A No. 11-65021 and in JP-A No. 2001-348546.

Preferred as the binder of the surface protective layer of the invention is gelatin, but polyvinyl alcohol (PVA) may be used preferably instead, or in combination with gelatin. As gelatin, there can be used an inert gelatin (e.g., Nitta gelatin 750), a phthalated gelatin (e.g., Nitta gelatin 801), and the like. Usable as PVA are those described in paragraph Nos. 0009 to 0020 of JP-A No. 2000-171936, and preferred are the completely saponified product PVA-105 and the partially saponified PVA-205 and PVA-335, as well as modified polyvinyl alcohol MP-203 (trade name of products from Kuraray Ltd.). The coating amount of polyvinyl alcohol (per 1 $m^2$ of support) in the protective layer (per one layer) is preferably in the range from 0.3 $g/m^2$ to 4.0 $g/m^2$, and more preferably, from 0.3 $g/m^2$ to 2.0 $g/m^2$.

The coating amount of total binder (including water-soluble polymer and latex polymer) (per 1 $m^2$ of support) in the surface protective layer (per one layer) is preferably in the range from 0.3 $g/m^2$ to 5.0 $g/m^2$, and more preferably, from 0.3 $g/m^2$ to 2.0 $g/m^2$. Further, the surface protective layer may preferably contain a lubricant such as liquid paraffin or aliphatic ester. An amount of the lubricant to be used is in the range from 1 $mg/m^2$ to 200 $mg/m^2$, preferably in the range from 10 $mg/m^2$ to 150 $mg/m^2$, and more preferably in the range from 20 $mg/m^2$ to 100 $mg/m^2$.

2) Antihalation Layer

The photothermographic material of the present invention may comprise an antihalation layer provided at the side farther from a light source with respect to the image forming layer.

Descriptions on antihalation layers can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case the exposure wavelength is in the infrared region, an infrared-absorbing dye may be used, and in such a case, preferred are dyes having no absorption in visible region.

In the case of preventing halation from occurring by using a dye having absorption in visible region, it is preferred that the color of the dye would not substantially remain after image formation, and is preferred to employ a means for bleaching color by the heat of thermal development. In particular, it is preferred to add a thermal bleaching dye and a base precursor to the non-photosensitive layer to impart the action of an antihalation layer. These techniques are described in JP-A No. 11-231457 and the like.

The addition amount of the thermal bleaching dye is determined depending on the usage of the dye. In general, it is used at an amount as such that the optical density (absorbance) exceeds 0.1 when measured at the desired wavelength. The optical density is preferably in the range from 0.15 to 2, and more preferably from 0.2 to 1. The addition amount of dyes to obtain optical density in the above range is generally from 0.001 $g/m^2$ to 1 $g/m^2$.

By decoloring dye in such a manner, the optical density after thermal development can be lowered to 0.1 or lower. Two or more kinds of thermal bleaching dyes may be used in combination in a photothermographic material. Similarly, two or more kinds of base precursors may be used in combination.

In the case of thermal decolorization by the combined use of a decoloring dye and a base precursor, it is advantageous from the viewpoint of thermal decoloring efficiency to further use a substance capable of lowering the melting point by at least 3° C. when mixed with the base precursor (e.g., diphenylsulfone, 4-chlorophenyl(phenyl)sulfone), or 2-napthyl benzoate as.

3) Back Layer

Back layers which can be used in the invention are described in paragraph Nos. 0128 to 0130 of JP-A No. 11-65021.

In the invention, coloring agents having a maximum absorption in the wavelength range from 300 nm to 450 nm may be added in order to improve color tone of developed silver images and the deterioration of images during aging. Such coloring agents are described in, for example, JP-A Nos. 62-210458, 63-104046, 63-103235, 63-208846, 63-306436, 63-314535, 01-61745, 2001-100363, and the like.

Such coloring matters are generally added in the range from 0.1 $mg/m^2$ to 1 $g/m^2$, preferably to the back layer which is provided on the opposite surface side of the support from the image forming layer.

Further, in order to control the basic color tone, it is preferred to use a dye having an absorption peak in the wavelength range from 580 nm to 680 nm. As a dye satisfying this purpose which have low absorption intensity on the short wavelength side, preferred are oil-soluble azomethine dyes described in JP-A Nos. 4-359967 and 4-359968, or water-soluble phthalocyanine dyes described in JP-A No. 2003-295388. The dyes for this purpose may be added to any of the layers, but more preferred is to add them to a non-photosensitive layer on the image forming surface side, or on the back surface side.

The photothermographic material of the invention is preferably a so-called one-sided photosensitive material that includes at least one image forming layer containing a silver halide emulsion on one side of the support, and a back layer on the other side of the support. Further, the photothermographic material of the invention is preferably used in the form of a cut sheet rather than a roll.

4) Matting Agent

In the invention, it is preferable to add a matting agent for improving transporting property. The matting agent is described in JP-A No.11-65021, paragraphs 0126–0127. An amount of the matting agent, in a coating amount per 1 $m^2$ of the photosensitive material, is preferably 1 to 400 $mg/m^2$, more preferably 5 to 300 $mg/m^2$.

In the invention, the matting agent may have a fixed shape or an amorphous shape, however it is preferably of a fixed shape, and a spherical shape is employed preferably.

The matting agent to be used on the surface of an image forming layer preferably has a volume-weighted average diameter of 0.3 to 10 μm, further preferably 0.5 to 7 μm·in terms of a sphere-equivalent diameter. Also a coefficient of variation in the size distribution of the matting agent is preferably 5 to 80%, more preferably 20 to 80%. The coefficient of variation is represented by (standard deviation of particle size)/(average of particle size)×100. It is also possible to use, in combination, two or more matting agents having different average particle sizes. In such case, a matting agent with a largest average particle size and a matting agent with a smallest average particle size preferably have a difference in the particle size of 2 to 8 μm, more preferably 2 to 6 μm.

The matting agent to be used in the back side preferably has a volume-weighted average of 1 to 15 μm, further preferably 3 to 10 μm in terms of a sphere-equivalent diameter. Also a coefficient of variation of the size distribution of the matting agent is preferably 3 to 50%, more preferably 5 to 30%. For the matting agent of the back side, it is also possible to use, in combination, two or more matting agents having different average particle sizes. In such case, a matting agent with a largest average particle size and a matting agent with a smallest average particle size preferably have a difference in the particle size of 2 to 14 μm, more preferably 2 to 9 μm.

In the invention, a matting degree of the back layer is preferably within the range of Beck's smoothness of 1200 to 10 seconds, more preferably 800 to 20 seconds and even more preferably 500 to 40 seconds.

In the invention, the matting agent is preferably included in an outermost surface layer of the photosensitive material, a layer functioning as an outermost surface layer, or a layer close to the external surface, or it is preferably included in a layer functioning as a protective layer.

5) Polymer Latex

Especially when the photothermographic material of the invention is used for printing applications where dimensional changes are a problem, it is preferable that a polymer latex is used in the surface protective layer and the back layer of the present invention. As such polymer latex, descriptions can be found in "Gosei Jushi Emulsion (Synthetic resin emulsions)" (Taira Okuda and Hiroshi Inagaki, Eds., published by Kobunshi Kankokai (1978)), "Gosei Latex no Oyo (Applications of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there can be mentioned a latex of methyl methacrylate (33.5% by mass)/ethyl acrylate (50% by mass)/methacrylic acid (16.5% by mass) copolymer, a latex of methyl methacrylate (47.5% by mass)/butadiene (47.5% by mass)/itaconic acid (5% by mass) copolymer, a latex of ethyl acrylate/methacrylic acid copolymer, a latex of methyl methacrylate (58.9% by mass)/2-ethylhexyl methacrylate (25.4% by mass)/styrene (8.6% by mass)/2-hydroethyl methacrylate (5.1% by mass)/acrylic acid (2.0% by mass) copolymer, a latex of methyl methacrylate (64.0% by mass)/styrene (9.0% by mass)/butyl acrylate (20.0% by mass)/2-hydroxyethyl methacrylate (5.0% by mass)/acrylic acid (2.0% by mass) copolymer, and the like.

Furthermore, as the binder for the surface protective layer, there can be applied the polymer latex combinations disclosed in JP-A No. 11-6872, the technology described in paragraph Nos. 0021 to 0025 of the specification of JP-A No.

2000-267226, the technology described in paragraph Nos. 0027 to 0028 of the specification of JP-A No. 11-6872 and the technology described in paragraph Nos. 0023 to 0041 of the specification of JP-A No. 2000 -19678. The polymer latex in the surface protective layer preferably is contained in an amount of 10% by mass to 90% by mass, particularly preferably, of 20% by mass to 80% by mass of the total mass of binder.

6) Surface pH

The surface pH of the photothermographic material according to the invention preferably has a pH of 7.0 or lower, and more preferably, 6.6 or lower, before the thermal developing process. Although there is no particular restriction concerning the lower limit, the lower limit of pH value is about 3, and the most preferred surface pH range is from 4 to 6.2. From the viewpoint of reducing the surface pH, it is preferred to use an organic acid such as a phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

7) Hardener

A hardener may be used in each of image forming layer, protective layer, back layer, and the like. As examples of hardeners, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193 and the like, epoxy compounds of U.S. Pat. No. 4,791,042 and the like, and vinyl sulfone compounds of JP-A No. 62-89048 and the like.

The hardener is added as a solution, and the solution is added to the coating solution for forming the protective layer 180 minutes before coating to just before coating, preferably 60 minutes before to 10 seconds before coating. However, so long as the effect of the invention is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "Liquid Mixing Technology" (Nikkan Kogyo Shinbun, 1989), and the like.

8) Surfactant

As for the surfactant, the solvent, the support, antistatic agent or electrically conductive layer, and the method for obtaining color images applicable in the invention, there can be mentioned those disclosed in paragraph Nos. 0132, 0133, 0134, 0135, and 0136, respectively, of JP-A No. 11-65021. Slip agents are described in paragraphs 0061 to 0064 of JP-A No. 11-84573 and paragraphs 0049 to 0062 of JP-A No. 2001-83679.

In the invention, it is preferred to use a fluorosurfactant. Specific examples of fluorosurfactants can be found in the compounds described in JP-A Nos. 10-197985, 2000-19680, and 2000-214554. Also the polymer fluorosurfactants described in JP-A 9-281636 can be used preferably. For the photothermographic material in the invention, the fluorocarbon surfactants described in JP-A Nos. 2002-82411, 2003-57780, and 2003-014976 can be preferably used. Especially, when manufacturing a coating liquid the usage of the fluorosurfactants described in JP-A Nos. 2003-57780 and 2001-264110 in an aqueous coating solution is preferred, from the perspective of capacity to control static, stability of the coating surface state and slippiness. The fluorosurfactant described in JP-A No. 2001-264110 is most preferred because of its high capacity to control static and the small amount that needs to be used.

According to the invention, fluorosurfactant can be used on either the image forming layer surface side or back layer surface side, but use on both sides is preferred. Further, combined use with an electrically conductive layer, including metal oxides described below, is particularly preferred. In this case sufficient functionality can be obtained with the amount of the fluorosurfactant on the side of the electrically conductive layer reduced or removed.

The addition amount of the fluorosurfactant is preferably in the range of from 0.1 $mg/m^2$ to 100 $mg/m^2$ on each of the image forming layer surface side and back layer surface side, more preferably from 0.3 $mg/m^2$ to 30 $mg/m^2$, and further preferably from 1 $mg/m^2$ to 10 $mg/m^2$. Especially, the fluorosurfactant described in JP-A No. 2001-264110 is effective, and used preferably in the range of from 0.01 $mg/m^2$ to 10 $mg/m^2$, and more preferably from 0.1 $mg/m^2$ to 5 $mg/m^2$.

9) Antistatic Agent

The photothermographic material of the invention preferably contains an electrically conductive layer including metal oxides or electrically conductive polymers. The antistatic layer may also serve as an undercoat layer, or a back surface protective layer, and the like, but can be specially provided. As an electrically conductive material of the antistatic layer, metal oxides having enhanced electric conductivity by the method of introducing oxygen defects or different types of metallic atoms into the metal oxides are preferably for use. Examples of metal oxides preferably selected are ZnO, $TiO_2$ and $SnO_2$. Examples of combinations of different types of atoms, preferred is ZnO with Al, In additions; $SnO_2$ with Sb, Nb, P, halogen atoms additions, and the like; $TiO_2$ with Nb, Ta, and the like additions.

Particularly preferred for use is $SnO_2$ with Sb additions. The addition amount of different types of atoms is preferably in the range of from 0.01 mol % to 30 mol %, and more preferably, in the range of from 0.1 mol % to 10 mol %. The shape of the metal oxides can include, for example, spherical, needle-like, or plate-like shape. The needle-like particles, with the ratio of (the major axis)/(the minor axis) which is more than 2.0, and more preferably, 3.0 to 50, is preferred, viewed from the standpoint of the electric conductivity effect. The metal oxides is used preferably in a range from 1 $mg/m^2$ to 1000 $mg/m^2$, more preferably from 10 $mg/m^2$ to 500 $mg/m^2$, and even more preferably from 20 $mg/m^2$ to 200 $mg/m^2$.

The antistatic layer can be placed on either of the image forming layer surface side or the back layer surface side, however it is preferably placed between the support and the back layer. Examples of the antistatic layer in the invention include described in paragraph number 0135 of JP-A No.

11-65021, JP-A Nos. 56-143430, 56-143431, 58-62646, and 56-120519, and in paragraph Nos. 0040 to 0051 of JP-A No. 11-84573, U.S. Pat. No. 5,575,957, and in paragraph Nos. 0078 to 0084 of JP-A No. 11-223898.

10) Support

As the transparent support, favorably used is a polyester, particularly, polyethylene terephthalate, which is subjected to heat treatment in the temperature range of from 130° C. to 185° C. in order to relax the internal strain caused by biaxial stretching which remains inside the film, and to remove strain ascribed to heat shrinkage generated during the thermal developing process. In the case of a photothermographic material for medical use, the transparent support may be colored with a blue dye (for instance, dye-1 described in the examples of JP-A No. 8-240877), or may be uncolored. As to the support, it is preferred to apply undercoating technology, such as the water-soluble polyesters described in JP-A No. 11-84574, a styrene-butadiene copolymer described in JP-A No. 10-186565, a vinylidene chloride copolymer described in JP-A No. 2000-39684 and paragraphs 0063 to 0080 of JP-A 11-106881 and the like. The moisture content of the support is preferably 0.5% by mass or less when coating for the image forming layer and back layer is conducted on the support.

11) Other Additives

Furthermore, antioxidants, stabilizing agents, plasticizers, UV absorbents, or coating aids may be added to the photothermographic material. Each of the additives is added to either of an image forming layer or a non-photosensitive layer. Reference can be made to WO No. 98/36322, EP-A No. 803764A1, JP-A Nos. 10-186567 and 10-18568, and the like.

12) Coating Method

The photothermographic material of the invention may be coated by any method. More specifically, various types of coating operations can be used including extrusion coating, slide coating, curtain coating, immersion coating, knife coating, flow coating, and extrusion coating using the type of hopper described in U.S. Pat. No. 2,681,294. Preferably used is extrusion coating or slide coating as described in pages 399 to 536 of Stephen F. Kistler and Petert M. Schweizer, "LIQUID FILM COATING" (Chapman & Hall, 1997), and most preferably used is slide coating. Example of the shape of the slide coater for use in slide coating is shown in FIG. 11b.1, page 427, of the same literature. If desired, two or more layers can be coated simultaneously by the method described in pages 399 to 536 of the same literature, or by the method described in U.S. Pat. No. 2,761,791 and British Patent No. 837095. Particularly preferred in the invention are the methods described in JP-A Nos. 2001-194748, 2002-153808, 2002-153803, and 2002-182333.

The coating solution for the layer containing organic silver salt in the invention is preferably a so-called thixotropic fluid. For the details of this technology, reference can be made to JP-A No. 11-52509. Viscosity of the coating solution for the image forming layer in the invention at a shear rate of 0.1 $s^{-1}$ is preferably in the range from 400 mPa·s to 100,000 mPa·s, and more preferably, from 500 mPa·s to 20,000 mPa·s. At a shear rate of 1000 $s^{-1}$, the viscosity is preferably in the range from 1 mPa·s to 200 mPa·s, and more preferably, from 5 mPa·s to 80 mPa·s.

In the case of mixing two types of liquids on preparing the coating solution of the invention, known imine mixers and in-plant mixers can be used favorably. Preferred imine mixers of the invention are described in JP-A No. 2002-85948, and in-plant mixers are described in JP-A No. 2002-90940.

The coating solution of the invention is preferably subjected to defoaming treatment to maintain the coating surface in good condition. Preferred defoaming treatment methods for the invention are described in JP-A No. 2002-66431.

In the case of applying the coating solution of the invention to the support, it is preferred to perform removal of electricity in order to prevent the adhesion of dust, particulates, and the like due to charge build up. Preferred examples of methods of electricity removal for use in the invention are described in JP-A No. 2002-143747.

Since a non-setting coating solution is used for the image forming layer in the invention, it is important to precisely control the drying air and the drying temperature. Preferred drying methods for use in the invention are described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in the range from 60° C. to 100° C. at the film surface, and time period for heating is preferably in the range from 1 second to 60 seconds. More preferably, the temperature of the heat treatment is in the range 70° C. to 90° C. at the film surface and time period for heating is 2 seconds to 10 seconds. A preferred method of heat treatment for the invention is described in JP-A No. 2002-107872.

Furthermore, the production methods described in JP-A Nos. 2002-156728 and 2002-182333 are favorably used in the invention in order to stably produce the photothermographic material of the invention continuously.

The photothermographic material is preferably of monosheet type (i.e., a type which can form image on the photothermographic material without using other sheets such as an image-receiving material).

13) Packaging Material

The photothermographic material of the invention is preferably packaged by a packaging material having a low oxygen permeation rate and/or a low moisture permeation rate, in order to avoid an alteration of the photographic performance during storage before use, and to suppress curl or bending. The oxygen permeation rate at 25° C. preferably 50 ml/atm·$m^2$·day or less, more preferably 10 ml/atm·$m^2$·day or less, and further preferably 1.0 ml/atm·$m^2$·day or less. The moisture permeation rate is preferably 10 g/atm·$m^2$·day or less, more preferably 5 g/atm·$m^2$·day or less, and further preferably 1 g/atm·$m^2$·day or less.

Specific examples of packaging materials having a low oxygen permeation rate and/or a low moisture permeation rate include the packaging materials described in JP-A Nos. 8-254793 and 2000-206653.

14) Other Applicable Techniques

Techniques which can be used for the photothermographic material of the invention also include those in EP803764A1, EP883022A1, WO98/36322, JP-A Nos. 56-62648, 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-20699, 2001-275471, 2001-275461, 2000-313204, 2001-292844, 2000-324888, 2001-293864, 2001-348546 and 2000-187298.

In the case of a multi-color photothermographic material, each image forming layer is in general, separated from each other by using a functional or nonfunctional barrier layer between each image forming layer as described in U.S. Pat. No. 4,460,681.

Constitution of the multi-color photothermographic material may include a combination of these two layers for each color. Alternatively, all ingredients may be included into a single layer as described in U.S. Pat. No. 4,708,928.

2. Image Forming Method

1) Exposure

The photothermographic material of the present invention is exposed with light having a peak wavelength in the range of from 350 nm to 450 nm. The light is preferably a laser beam, more preferably a laser beam emitted from a semiconductor, most preferably a blue laser beam emitted from a semiconductor.

In recent years, development has been made particularly on a light source module with an SHG (a second harmonic generator) and a laser diode integrated into a single piece whereby a laser output apparatus in a short wavelength region has come into the limelight. A blue laser diode enables high definition image recording and makes it possible to obtain an increase in recording density and a stable output over a long lifetime, which results in expectation of an expanded demand in the future.

Laser beam which oscillates in a longitudinal multiple modulation by a method such as high frequency superposition is also preferably employed.

2) Thermal Development

Although the development of the photothermographic material of the invention, any method may be used for the thermal development process, the thermal development is usually performed by elevating the temperature of the photothermographic material exposed imagewise. The temperature for the development is preferably 80° C. to 250° C., more preferably 100° C. to 140° C., and further preferably 110° C. to 130° C. Time period for the development is preferably 1 second to 60 seconds, more preferably 3 seconds to 30 seconds, further preferably 5 seconds to 25 seconds, and particularly preferably 7 seconds to 15 seconds.

During thermal development, the photothermographic material is conveyed preferably at a linear velocity of not less than 23 mm/second.

The thermal development may be carried out by either of a drum heater or a plate heater, however, use of a drum heater is preferable. If the image forming layer has a protective layer on an image forming layer, it is preferable to bring the protective layer side of the photothermographic material in contact with the heater, to achieve uniform heating. Further, it is preferable to carry out the thermal development while the photothermographic material is being conveyed with the protective layer side thereof being in contact with the heater, in view of heat efficiency and operational efficiency.

3) System

Examples of a medical laser imager including an exposure section and a thermal development section are FUJI MEDICAL DRY LASER IMAGER FM-DPL and DRYPIX7000, and Kodak's DRY VIEW 8700 LASER IMAGER PLUS. Details of FM-DPL are described in "Fuji Medical Review", No. 8, pp. 39–55, and the technologies thereof are applied as a laser imager for use with the photothermographic material of the invention. Further, the photothermographic material of the invention can be applied as a photothermographic material for a laser imager for use in "AD network" that has been proposed by Fuji film Medical Co., Ltd. as a network system in compliance with the DICOM standard.

(Applicability of the Invention)

The photothermographic material of the invention forms a black and white image formed of a silver image, and is preferably used as a photothermographic material for medical diagnosis, for industrial photography, for printing and for COM. The photothermographic material of the invention is particularly preferably used for medical diagnosis.

EXAMPLES

The present invention is specifically explained by way of Examples below, which should not be construed as limiting the invention thereto.

Example 1

(Preparation of PET Support)

1) Film Manufacturing

PET having IV (intrinsic viscosity) of 0.66 (measured in phenol/tetrachloroethane=6/4 (mass ratio) at 25° C.) was obtained according to a conventional manner using terephthalic acid and ethylene glycol. The product was pelletized, dried at 130° C. for 4 hours, melted at 300° C. Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

2) Surface Corona Discharge Treatment

Both surfaces of the support were treated at room temperature at 20 m/minute using Solid State Corona Discharge Treatment Machine Model 6 KVA manufactured by Piller GmbH. It was proven that treatment of 0.375 kV·A·minute/m$^2$ was performed, judging from the readings of current and voltage at the treatment. The frequency upon this treatment was 9.6 kHz, and the gap clearance between the electrode and dielectric roll was 1.6 mm.

3) Undercoating

<Preparations of Coating Solution for Undercoat Layer>

Formula (1) (for undercoat layer on the image forming layer side)

| | |
|---|---|
| PESRESIN A-520 manufactured by Takamatsu Oil & Fat Co., Ltd. (30% by mass solution) | 46.8 g |
| BYLONAL MD-1200 manufactured by Toyobo Co., Ltd. | 10.4 g |
| Polyethyleneglycol monononylphenylether (average ethylene oxide number = 8.5) 1% by mass solution | 11.0 g |
| MP-1000 manufactured by Soken Chemical & Engineering Co., Ltd. (polymer fine particle, mean particle diameter of 0.4 μm) | 0.91 g |
| Distilled water | 931 mL |

Formula (2) (for first layer on the back surface)

| | |
|---|---|
| Styrene-butadiene copolymer latex (solid content of 40% by mass, styrene/butadiene mass ratio = 68/32) | 130.8 g |
| 8% by mass aqueous solution of 2,4-dichloro-6-hydroxy-S-triazine sodium salt | 5.2 g |
| 1% by mass aqueous solution of sodium laurylbenzenesulfonate | 10 mL |
| Stylene particle dispersion (Average particle diameter; 2 μm: 20% by mass) | 0.5 g |
| Distilled water | 854 mL |

Formula (3) (for second layer on the back surface)

| | |
|---|---|
| $SnO_2$/SbO (9/1 mass ratio, mean particle diameter of 0.038 μm, 17% by mass dispersion) | 84 g |
| Gelatin (10% by mass aqueous solution) | 7.9 g |
| METOLOSE TC-5 manufactured by Shin-Etsu Chemical Co., Ltd. (2% by mass aqueous solution) | 10 g |
| 1% by mass aqueous solution of sodium dodecylbenzenesulfonate | 10 mL |
| NaOH (1% by mass) | 7 g |
| Proxel (manufactured by Imperial Chemical Industries PLC) | 0.5 g |
| Distilled water | 881 mL |

<Undercoating>

Both surfaces of the biaxially tentered polyethylene terephthalate support having the thickness of 175 μm were subjected to the corona discharge treatment as described above. Thereafter, the aforementioned formula (1) of the coating solution for the undercoat was coated on one surface (image forming layer side) with a wire bar so that the amount of wet coating became 6.6 mL/m$^2$ (per one side), and dried at 180° C. for 5 minutes. Then, the aforementioned formula (2) of the coating solution for the undercoat was coated on the reverse face (back surface) with a wire bar so that the amount of wet coating became 5.7 mL/m$^2$, and dried at 180° C. for 5 minutes. Furthermore, the aforementioned formula (3) of the coating solution for the undercoat was coated on the reverse face (back surface) with a wire bar so that the amount of wet coating became 7.7 mL/m$^2$, and dried at 180° C. for 6 minutes. Thus, an undercoated support was produced.

1) (Back Layer)

<Preparation of Coating Solution for Antihalation Layer>

32.7 g of lime-processed gelatin, 0.77 g of monodispersed polymethyl methacrylate fine particles (mean particle size of 8 μm, standard deviation of particle diameter of 0.4), 0.08 g of benzoisothiazolinone, 0.3 g of sodium polystyrene sulfonate, 0.06 g of the blue dye-1, 1.5 g of the ultraviolet absorber-1, 5.0 g of acrylic acid/ethylacrylate copolymer latex (copolymerization ratio; 5/95), and 1.7 g of N,N-ethylene bis(vinylsulfoneacetoamide were added to water kept at 40° C., and mixed. 1 mole/L aqueous sodium hydroxide solution was added to the resultant mixture to adjust the pH value to 6.0, and water was added thereto to form the total quantity thereof 818 ml to give a coating solution for an antihalation layer.

2) Preparation of Coating Solution for Back Surface Protective Layer 66.5 g of lime-processed gelatin, liquid paraffin emulsion (5.4 g in terms of liquid paraffin), 0.10 g of benzoisothiazolinone, 0.5 g of di(2-ethylhexyl) sodium sulfosuccinate, 13.6 ml of a 2% by mass solution of a fluorosurfactant (F-1), and 10.0 g of acrylic acid/ethylacrylate copolymer (copolymerization ratio; 5/95) were added to water kept at 40° C., and mixed. A 1 mole/L aqueous sodium hydroxide solution was added to the resultant mixture to adjust the pH value to 6.0, and water was added thereto to form the total quantity thereof 1000 ml to give a coating solution for a back surface protective layer.

3) Coating

The back surface side of the undercoated support as described above was subjected to simultaneous double coating so that the coating solution for the antihalation layer gives the coating amount of gelatin of 1.70 g/m$^2$, and so that the coating solution for the back surface protective layer gives the coating amount of gelatin of 0.79 g/m$^2$, followed by drying to produce a back layer.

Blue dye compound-1

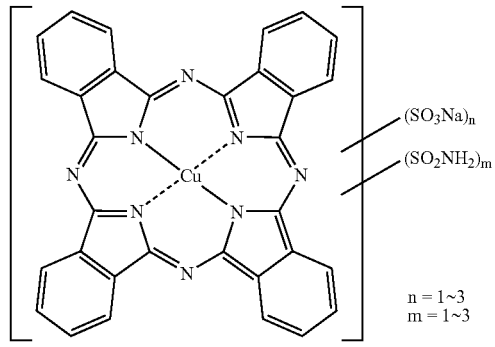

UV absorber-1

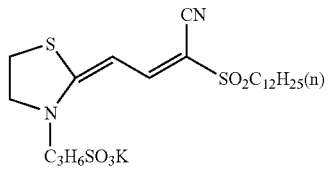

-continued (F-1)

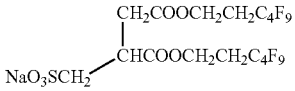

(F-2)

Mixture of

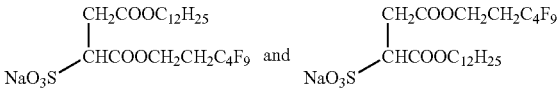

3. (Image Forming Layer, Intermediate Layer, and Surface Protective Layer)

3-1. Preparations of Materials for Coating

1) Silver Halide Emulsion

<<Preparation of Silver Halide Emulsion-1>>

To 1421 mL of distilled water was added 4.3 mL of a 1% by mass potassium bromide solution. Further, a liquid added with 3.5 mL of sulfuric acid having a concentration of 0.5 mole/L and 36.7 g of phthalated gelatin was kept at 43° C. while stirring in a stainless steel reaction vessel, and thereto were added total amount of; solution A prepared through diluting 22.22 g of silver nitrate by adding distilled water to give the volume of 195.6 mL; and solution B prepared through diluting 21.8 g of potassium iodide with distilled water to give the volume of 218 mL, over 9 minutes at a constant flow rate. Thereafter, 10 mL of a 1.5% by mass aqueous solution of hydrogen peroxide was added thereto, and 10.8 mL of a 10% by mass aqueous solution of benzimidazole was further added.

Moreover, a solution C prepared through diluting 51.86 g of silver nitrate by adding distilled water to give the volume of 317.5 mL and a solution D prepared through diluting 60 g of potassium iodide with distilled water to give the volume of 600 mL were added. A controlled double jet method was carried out through adding total amount of the solution C at a constant flow rate over 120 minutes, accompanied by adding the solution D while maintaining the pAg at 8.1. The rotal amount of hexachloroiridium (III) potassium salt was added to give $1\times10^{-4}$ mole per one mole of silver at 10 minutes after the initiation of the addition of the solution C and the solution D. Moreover, at 5 seconds after completing the addition of the solution C, a potassium iron (II) hexacyanide aqueous solution was added at a total amount of $3\times10^{-4}$ mole per one mole of silver. The mixture was adjusted to the pH of 3.8 with sulfuric acid at the concentration of 0.5 mole/L. After stopping stirring, the mixture was subjected to precipitation/desalting/water washing steps. The mixture was adjusted to the pH of 5.9 with sodium hydroxide at the concentration of 1 mole/L to produce a silver halide dispersion having the pAg of 8.0.

The silver halide dispersion was kept at 38° C. with stirring, and thereto was added 5 mL of a 0.34% by mass methanol solution of 1,2-benzoisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mole per one mole of silver. At additional 5 minutes later, a tellurium sensitizer C in a methanol solution was added at $2.9\times10^{-4}$ mole per one mole of silver and subjected to ripening for 91 minutes. Thereafter, 1.3 mL of a 0.8% by mass N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mole per one mole of silver, and 1-phenyl-2-heptyl-5-mercapto-1,3,4-triazole in a methanol solution at $5.4\times10^{-3}$ mole per one mole of silver were added to produce a silver halide emulsion-1.

Grains in thus prepared silver halide emulsion were pure silver iodide grains having a mean sphere equivalent diameter of 0.040 μm, and a variation coefficient of 18%.

Grain size and the like were determined from the average of 1000 grains using an electron microscope.

<<Preparation of Silver Halide Emulsion-2>>

Preparation of silver halide emulsion-2 was conducted in a similar manner to the process in the preparation of the silver halide emulsion-1 except that: the temperature of the reaction solution was changed to 65° C.; 5 ml of 5% methanol solution of 2,2'-(ethylenedithio) diethanol was added after the solutions A and B were added, the solution D was added by a controlled double jet method while the pAg value was maintained at 10.5, and 5×10−4 mole of bromoauric acid and $2.0\times10^{-3}$ mole of potassium thiocyanate per mole silver were added at 3 minutes after the tellurium sensitizer C was added. The emulsion grains in the silver halide emulsion-2 were tabular pure silver iodide grains having a mean sphere equivalent diameter of 0.164 μm of a projection area, a grain thckness of 0.032 μm, an average aspect ratio of 5, and a mean sphere equivalent diameter of 0.11 μm and a variation coefficient of 23%. A ratio of γ phase thereof was measured by X-ray powder diffraction analysis and found to be 80%. Grain size and the like were determined from the average of 1000 grains using an electron microscope.

<<Preparation of Silver Halide Emulsion 3>>

A silver halide emulsion 3 was prepared in the same manner as the preparation of the silver halide emulsion 1, except that the temperature of the reaction solution was changed to 27° C., and the solution D was added by the controlled double jet method while the pAg value was maintained at 10.2.

Grains in the thus prepared silver halide emulsion were pure silver iodide grains having a mean sphere equivalent diameter of 0.022 μm, and a variation coefficient of the sphere equivalent diameters thereof was 17%. Further, the silver iodide grains were dodecahedron grains having (001), {1(−1)0}, {101} planes, and were found by X-ray powder diffraction analysis to be formed mostly of β phase. Grains size, and the like, was determined from the average of 1000 grains using an electron microscope.

<<Preparation of Emulsion Mixture A for Coating Solution>>

The silver halide emulsion 1, the silver halide emulsion 2 and the silver halide emulsion 3 were dissolved in such amounts that a mole ratio of silver was 5:2:3, and an aqueous 1% by mass benzothiazolium iodide solution was added thereto in an amount of $7\times10^{-3}$ mole per one mole of silver.

Further, compounds 1, 2 and 3, which form, when subjected to one-electron oxidation, one-electron oxidized product that may release one or more electrons, were added respectively in an amount of $2\times10^{-3}$ mole per one mole of silver in the silver halide.

Furthermore, compounds 1 and 2 having an adsorbing group and a reducing group were added respectively in an amount of $8\times10^{-3}$ mole per one mole of the silver halide.

Moreover, water was added such that a content of the silver halide in terms of silver was 15.6 g per one liter of the emulsion mixture for coating solution.

<<Preparation of Dispersion of Silver Salt of Fatty Acid B>>

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. Thus resulting crystal was subjected to centrifugal filtration, and washing was performed with 100 kg of isopropyl alcoholy. Thereafter, the crystal was dried. Thus resulting crystal was esterified, and subjected to GC-FID analysis to give the results of the content of behenic acid being 96 mole %. Other than the behenic acid, lignoceric acid was included at 2 mole %, arachidic acid was included at 2 mole %, and erucic acid was included at 0.001 mole %.

<Preparation of Nano Particles of Silver Behenate>

In a reaction vessel, deionized water, 10% solution of dodecyl thiopolyacrylamide surfactant (72 g) and 46.6 g of recrystallized behenic acid were placed. The content in the reaction vessel was heated at 70° C. with stirring at 150 rpm, while 10% potassium hydroxide solution (70.6 g) was added to the vessel. Thereafter, the content in the reaction vessel was heated at 80° C., and maintained at the same temperature for 30 minutes until the content became a turbid solution. Next, the reaction mixture was cooled to 70° C., and a silver nitrate solution (100% solution, 21.3 g) was added to the reaction vessel over 30 minutes by controlling adding speed. The content in the reaction vessel was maintained at the reaction temperature, cooled to room temperature, and decanted, so that a nanoparticle silver behenate dispersion having a 150 nm nedian grain size was obtained (solid content 3%).

<<Purification and Concentration of Nano-Grain Silver Behenate>>

A nano-grain silver behenate dispersion (12 kg) with a solid content of 3% by mass was placed in a diafiltration/ultrafiltration apparatus (equipped with a Osmonics Model 21-HZ20-S8J osmosis membrane cartridge having an effective surface area of 0.34 $m^2$ and a nominal molecular weight cutoff of 50,000). The apparatus was operated under conditions of: a pressure applied to the osmosis membrane being 3.5 $kg/cm^2$ (50 $lb/in^2$); and a pressure at a downstream side of the osmosis membrane being 20 $kg/cm^2$ (50 $lb/in^2$). Through this process, penetrant was replaced with deionized water until the 24 kg of penetrant was removed from the dispersion. When the 24 kg of penetrant was removed from the dispersion, the replacing water was stopped, and the apparatus was operated until the dispersion reached a concentration of 28% by mass solid content, to obtain a nano-grain silver behenate dispersion.

3) Preparations of Reducing Agent Dispersion

<<Preparation of Reducing Agent-1 Dispersion>>

To 10 kg of a reducing agent-1 (2,2'-methylenebis-(4-ethyl-6-tert-butylphenol)) and 16 kg of a 10% by mass aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was dispersed by a horizontal sand mill (UVM-2: manufactured by IMEX Co., Ltd.) packed with zirconia beads having the mean particle diameter of 0.5 mm for 3 hours. Thereafter, 0.2 g of a benzoisothiazolinone sodium salt and water were added thereto, thereby adjusting the concentration of the reducing agent to be 25% by mass. This dispersion was subjected to heat treatment at 60° C. for 5 hours to obtain a reducing agent-1 dispersion. Particles of the reducing agent included in the resulting reducing agent dispersion had a median diameter of 0.40 μm, and a maximum particle diameter of 1.4 μm or less. The resultant reducing agent dispersion was subjected to filtration through a polypropylene filter having a pore size of 3.0 μm to remove foreign substances such as dust, and stored.

4) Preparations of Polyhalogen Compound Dispersion

<<Preparation of Organic Polyhalogen Compound-1 Dispersion>>

10 kg of an organic polyhalogen compound-1 (tribromomethane sulfonylbenzene), 10 kg of a 20% by mass aqueous solution of modified polyvinyl alcohol (manufactured by Kuraray Co., Ltd., Poval MP203), 0.4 kg of a 20% by mass aqueous solution of sodium triisopropylnaphthalenesulfonate and 14 kg of water were added, and thoroughly admixed to give a slurry. This slurry was fed with a diaphragm pump, and was dispersed by a horizontal sand mill (UVM-2: manufactured by IMEX Co., Ltd.) packed with zirconia beads having the mean particle diameter of 0.5 mm for 5 hours. Thereafter, 0.2 g of a benzoisothiazolinone sodium salt and water were added thereto, thereby adjusting the concentration of the organic polyhalogen compound to be 26% by mass. Thus, an organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less. The resultant organic polyhalogen compound dispersion was subjected to filtration through a polypropylene filter having a pore size of 10.0 μm to remove foreign substances such as dust, and stored.

<<Preparation of Organic Polyhalogen Compound-2 Dispersion>>

An organic polyhalogen compound-2 (N-butyl-3-tribromomethane sulfonylbenzoamide) in an amount of 10 kg, 20 kg of a 10% by mass aqueous solution of modified polyvinyl alcohol (manufactured by Kuraray Co., Ltd., Poval MP203), and 0.4 kg of a 20% by mass aqueous solution of sodium triisopropylnaphthalenesulfonate were added, and thoroughly admixed to give a slurry. This slurry was fed with a diaphragm pump, and was dispersed by a horizontal sand mill (UVM-2: manufactured by IMEX Co., Ltd.) packed with zirconia beads having the mean particle diameter of 0.5 mm for 5 hours.

Thereafter, 0.2 g of a benzoisothiazolinone sodium salt and water were added thereto, thereby adjusting the concentration of the organic polyhalogen compound to be 30% by mass. This dispersion was heated at 40° C. for 5 hours to obtain an organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration through a polypropylene filter having a pore size of 3.0 μm to remove foreign substances such as dust, and stored.

5) Preparation of Pigment-1 Dispersion 64 g of C.I. Pigment Blue 60 and 6.4 g of DEMOL N manufactured by Kao Corporation were added to 250 g of water and thoroughly mixed to give a slurry. Zirconia beads having the mean particle diameter of 0.5 mm were provided in an amount of 800 g, and charged in a vessel with the slurry. Dispersion was performed with a dispersing machine (¼G sand grinder mill: manufactured by IMEX Co., Ltd.) for 25 hours. Thereto was added water to adjust so that the concentration of the pigment became 5% by mass to obtain a pigment-1 dispersion. Particles of the pigment included in the resulting pigment dispersion had a mean particle diameter of 0.21 μm.

6) Preparation of Aqueous Solution

The following compounds were added in a form of an aqueous solution.

The compound represented by Formula (I) or (II): added in a form of an aqueous 5% by mass succinimide solution.

Preparation of an aqueous solution of 4-methylphthalic acid: 4-methylphthalic acid was added in a form of an aqueous 5% by mass solution.

Preparation of silver iodide complexing agent A: 8 kg of modified polyvinyl alcohol MP203 was dissolved in 174.57 kg of water, and then, 3.15 kg of an aqueous 20% by mass sodium triisopropylnaphthalenesulfonate solution and 14.28 kg of an aqueous 70% by mass 6 isopropylphthalazine solution were added thereto to prepare a 5% by mass solution of the silver iodide complexing agent.

Preparation of silver iodide complexing agent B: 8 kg of modified polyvinyl alcohol MP203 was dissolved in 174.57 kg of water, and then, 3.15 kg of an aqueous 20% by mass sodium triisopropylnaphthalenesulfonate solution and 14.28 kg of an aqueous 70% by mass 6-isobutylphthalazine solution were added thereto to prepare a 5% by mass solution of the silver iodide complexing agent.

3-2. Preparation of Coating Solution

1) Preparation of Image Forming Layer Coating Solution 1 to 8

In a container kept at 40° C., 450 ml of water and 200 g of gelatin were added. After the gelatin had dissolved, the above-obtained dispersion of fatty acid silver salt, the pigment-1 dispersion, the organic polyhalogen compound-1 dispersion, the organic polyhalogen compound-2 dispersion, succinimide, the reducing agent dispersion, the silver iodide complexing agent solution (shown in Table 1), the aqueous 4-methylphthalic acid solution and sodium iodide were sequentially added thereto. Then, immediately before coating, the emulsion mixture A for coating solution was added and mixed well to prepare an image forming layer coating solution, which was fed directly to a coating die.

An amount of zirconium in the coating solution was 0.18 mg per one gram of silver.

2) Preparation of Surface Protective Layer Coating Solution

In a container kept at 40° C., 2400 ml of water and 300 g of gelatin were added. After the gelatin had dissolved, 60 g of an aqueous 5% by mass sodium di(2-ethylhexyl) sulfosuccinate solution and 900 g of an aqueous succinimide solution were sequentially added and mixed well to prepare a surface protective layer coating solution.

4. Preparation of Coating Samples 4-1. Preparation of Samples 1 to 8 of the Invention On a side of the support opposite to the back surface side, an image forming layer and a surface protective layer laminated in this order from the undercoat layer were simultaneously coated by slide bead coating to prepare samples of the photothermographic material. At this time, temperatures of the coating solutions for the image forming layer and the surface protective layer were adjusted to 37° C.

Coating amounts ($g/m^2$) of the respective compounds in the image forming layer were shown below. Further, the surface protective layer was coated such that a dry coating amount of gelatin was 2.0 $g/m^2$.

| | |
|---|---|
| Fatty acid silver salt | 5.42 |
| Pigment (C.I. Pigment Blue 60) | 0.036 |
| Polyhalogen compound-1 | 0.10 |
| Polyhalogen compound-2 | 0.34 |
| 4-methylphthalic acid | 0.08 |
| Succinimide | 0.54 |
| Silver iodide complexing agent | (shown in Table 1) |
| Gelatin | 3.90 |
| Sodium iodide | 0.04 |
| Reducing agent-1 | 0.75 |
| Silver halide (as Ag) | 0.1 |

4-2. Preparation of Comparative Coating Samples

1) Preparation of Comparative Photosensitive Silver Halide Emulsion

<Preparation of Silver Halide Emulsion 4>

In a reaction vessel containing 400 g of a solution of a 4% phthalated bone gelatin, kept at a temperature of 40° C., pH of 5.6 and a vAg of 90 mV (Ag/AgCl reference electrode), vigorously agitated, a predetermined amount of 2.5 mole $AgNO_3$ solution was added, and then, a 2.5 mole NaBrI solution containing 36 mole % of iodide was added at a flow rate necessary for maintaining the vAg. A total of 0.5 mole of silver was added. During the above process, a potassium salt of hexachloroiridium (III) acid was added in an amount of $1\times10^{-4}$ mole per one mole of silver. Then, 5 seconds after completion of the addition, an aqueous solution of potassium hexacyanoferrate (II) was added in an amount of $3\times10^{-4}$ mole per one mole of silver. Using sulfuric acid with a concentration of 0.5 mole/L, a pH of the mixture was controlled to 3.8. Then, agitation was stopped and steps of precipitation, desalting and washing with water were carried out. Using sodium hydroxide with a concentration of 1 mole/L, the pH of the mixture was controlled to 5.9, to prepare a silver halide dispersion with a pAg of 8.0.

The above silver halide dispersion was agitated and kept at 38° C., and 5 ml of a 0.34% by mass methanol solution of 1,2-benzoisothiazoline-3-one was added thereto. Then, temperature was raised to 47° C. 20 minutes after the raising of temperature, a methanol solution of sodium benzenethiosulfonate was added in an amount of $7.6\times10^{-5}$ mole per one mole of silver, and at 5 minutes thereafter, a methanol solution of a tellurium sensitizer C was added in an amount of $2.9\times10^{-4}$ mole per one mole of silver, and ripened for 91 minutes.

Thereafter, 1.3 ml of 0.8% by mass methanol solution of N,N'-dihydroxy-N",N"-diethylmelamine was added, and at 4 minutes thereafter, a methanol solution of 5-methyl-2-mercaptobenzoimidazole was added in an amount of $4.8\times10^{-3}$ mole per one mole of silver, and a methanol solution of 1-phenyl-2-heptyl-5-mercapto-1,3,4-triazole was added in an amount of $5.4\times10^{-3}$ mole per one mole of silver, to prepare a silver halide emulsion 4.

Grains in the thus prepared silver halide emulsion were silver bromoiodide grains having a mean sphere equivalent diameter of 0.040 μm, and a variation coefficient of the sphere equivalent diameters thereof was 18%. An iodide content thereof measured by X-ray powder diffraction analysis was 36 mole %. Grains size, and the like, was determined from the average of 1000

<Preparation of Silver Halide Emulsion 5>

A silver halide emulsion 5 was prepared in the same manner as the silver halide emulsion 4, except that the temperature of the reaction vessel was set to 27° C., and the flow rate of the $AgNO_3$ solution to be added in a predetermined amount, was doubled.

Grains in the thus prepared silver halide emulsion were silver bromoiodide grains having a mean sphere equivalent diameter of 0.022 μm, and a variation coefficient of the sphere equivalent diameters thereof was 20%. An iodide content thereof measured by X-ray powder diffraction analysis was 36 mole %. Grains size, and the like, was determined from the average of 1000 grains using an electron microscope.

<Preparation of Emulsion Mixture B for Coating Solution>

An emulsion mixture B for coating solution was prepared in the same manner as the emulsion mixture A for coating solution, except that the silver halide emulsion 1 was replaced with the silver halide emulsion 4 and the silver halide emulsion 3 was replaced with the silver halide emulsion 5.

2) Preparation of Coating Samples

Comparative samples 9 to 11 were prepared in the same manner as the samples 1 to 8, except that the emulsion mixture A for coating solution was replaced with the emulsion mixture B for coating solution, as shown in Table 1.

Chemical structures of the compounds used in Examples of the invention are shown below.

Tellurium sensitizer C

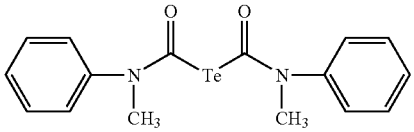

Compound 1 which forms, when subjected to one-electron oxidation, a one-electron oxidized product that may release one or more electrons

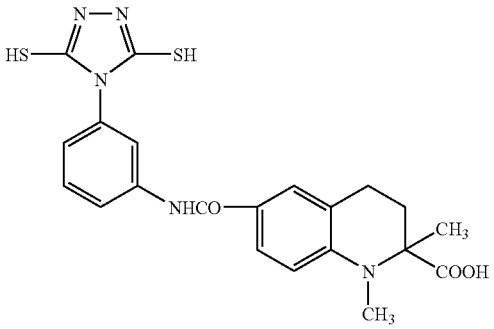

Compound 2 which forms, when subjected to one-electron oxidation, a one-electron oxidized product that may release one or more electrons.

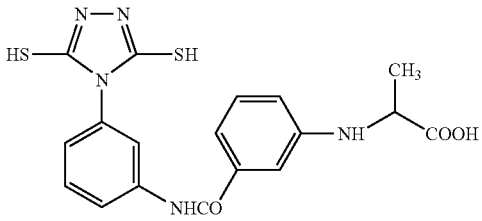

Compound 3 which forms, when subjected to one-electron oxidation, a one-electron oxidized product that may release one or more electrons.

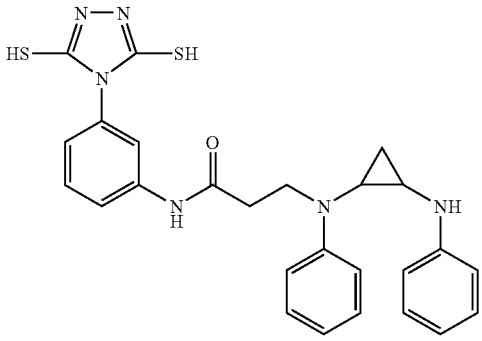

Compound 1 having an adsorbing group and a reducing group

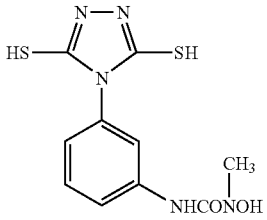

Compound 2 having an adsorbing group and a reducing group

TABLE 1

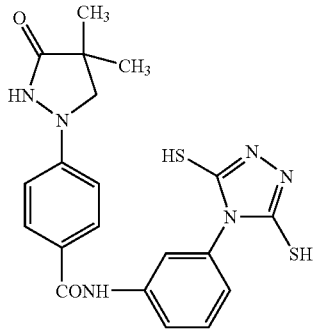

(Polyhalogen compound-1)

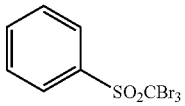

(Polyhalogen compound-2)

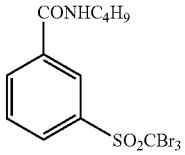

(Reducing agent-1)

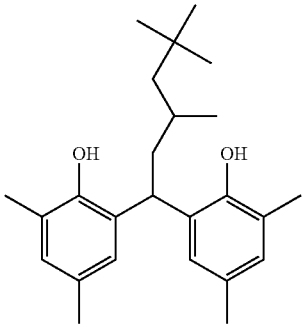

| Sample No. | Silver halide emulsion 3 compositions | Silver iodide complexing agent A Amount (g/m$^2$) | Silver iodide complexing agent B Amount (g/m$^2$) | Coating surface condition | Remarks |
|---|---|---|---|---|---|
| 1 | Emulsions 1, 2, 3 (all of which are pure silver iodide) | — | — | Good | Present Invention |
| 2 | Emulsions 1, 2, 3 (all of which are pure silver iodide | 0.12 | — | Good | Present Invention |
| 3 | Emulsions 1, 2, 3 (all of which are pure silver iodide | 0.18 | — | Good | Present Invention |
| 4 | Emulsions 1, 2, 3 (all of which are pure silver iodide | 0.24 | — | Good | Present Invention |
| 5 | Emulsions 1, 2, 3 (all of which are pure silver iodide | 0.30 | — | Good | Present Invention |
| 6 | Emulsions 1, 2, 3 (all of which are pure silver iodide | — | 0.18 | Good | Present Invention |
| 7 | Emulsions 1, 2, 3 (all of which are pure silver iodide | — | 0.30 | Good | Present Invention |

TABLE 1-continued

| | | | | | |
|---|---|---|---|---|---|
| 8 | Emulsions 1, 2, 3 (all of which are pure silver iodide | 0.18 | 0.12 | Good | Present Invention |
| 9 | Emulsions 4, 5 (AgI = 36 mole %), and Emulsion 2 (pure silver iodide) | — | — | Good | Comparative Example |
| 10 | Emulsions 4, 5 (AgI = 36 mole %), and Emulsion 2 (pure silver iodide) | 0.30 | — | Good | Comparative Example |
| 11 | Emulsions 4, 5 (AgI = 36 mole %), and Emulsion 2 (pure silver iodide | 0.18 | 0.12 | Good | Comparative Example |

5. Performance Evaluation 5-1. Coating Surface Condition

Both of the samples of the present invention and the comparative samples had good coating surface conditions without defects such as streaks or lumps due to coagulations.

5-2. Photographic Performances 5-2) Preparation

1) The resulting samples were cut into a size of 43 cm in length and 35 cm in width, and was wrapped with the following packaging material under the conditions of 25° C. and 50% RH, and stored for 2 weeks at an ambient temperature.

(Packaging Material)

A film laminated with PET 10 μm/PE 12 μm/aluminum foil 9 μm/Ny 15 μm/polyethylene 50 μm containing carbon at 3% by mass:

Oxygen permeability at 25° C.: 0.02 $mL \cdot atm^{-1}\ m^{-2}\ day^{-1}$;

Vapor permeability at 25° C.: 0.10 $g \cdot atm^{-1}\ m^{-2}\ day^{-1}$.

2) Exposure and Development of Photothermographic Materials

An NLHV3000E SEMICONDUCTOR LASER manufactured by Nichia Corporation serving as a semiconductor laser light source was set at an exposing section of a dry laser imager DRYPIX7000 manufactured by Fuji film Medical Co., Ltd., and the beam diameter was reduced to 100 μm. The samples were respectively exposed for $10^{-5}$ second with illuminance of the laser light at the surface of the photothermographic material was varied between 0 and in the range from 1 $mW/mm^2$ to 1000 $mW/mm^2$. A oscillating wavelength of the laser light was 405 nm. Thermal development was carried out with three panel heaters set at 107° C., 121° C. and 121° C., respectively, such that a total developing time was 14 seconds. A linear velocity for conveying the samples was 25 mm/second.

Resulting images were evaluated with a densitometer.

3) Evaluation Items

Fogging: densities of non-image areas were measured with a Macbeth densitometer.

Sensitivity: sensitivities were represented by inverse numbers of exposure amounts which resulted in blackening density of fogging+1.0, and sensitivities of the respective samples were indicated by relative values to the sensitivity of sample 1 being 100.

Color tone: color tones of images formed on the samples immediately after the thermal development were evaluated. It is preferable that the color of a resulting silver image is pure black. Based on this point, sensory evaluation was carried out by indicating a slightly yellowish image with a negative value and a bluish image with a positive value according to the following criteria:

+2: fairly bluish,

+1: slightly bluish,

0: pure black with well balanced color tone,

−1: slightly yellowish, and

−2: fairly yellowish.

Images with value 0 had preferable color tone, and those with values higher or lower than 0 had less preferable color tone.

4) Image Preservability (Print Out)

Thermally developed samples were cut to a size of 43 cm in length and 35 cm in width, and were kept for 24 hours in an environment of 30° C. and 70% RH, under a fluorescent light with an illuminance of 1000 lux. Then, an increase in fogging density (ΔDmin) of each sample was evaluated.

5) Results

The results are shown in Table 2. The photothermographic materials of the invention had high sensitivity and good color tone. Further, observed print out of the photothermographic materials of the invention was a half or less of those of the comparative photothermographic materias, and therefore, the photothermographic materials of the invention had good image preservability.

TABLE 2

| Sample | Photographic performance | | | Print out | |
|---|---|---|---|---|---|
| No. | Fogging | Sensitivity | Color tone | (ΔDmin) | Remarks |
| 1 | 0.17 | 100 | 0 | 0.028 | Present invention |
| 2 | 0.17 | 100 | 0 | 0.020 | Present invention |
| 3 | 0.17 | 100 | 0 | 0.016 | Present invention |
| 4 | 0.17 | 98 | 0 | 0.013 | Present invention |
| 5 | 0.16 | 95 | 0 | 0.011 | Present invention |
| 6 | 0.17 | 98 | 0 | 0.021 | Present invention |
| 7 | 0.17 | 98 | 0 | 0.018 | Present invention |
| 8 | 0.17 | 98 | 0 | 0.015 | Present invention |
| 9 | 0.17 | 76 | 0 | 0.057 | Comparative |
| 10 | 0.17 | 66 | −1 | 0.058 | Comparative |
| 11 | 0.17 | 69 | −1 | 0.056 | Comparative |

According to the invention, a photothermographic material that has a good coating surface condition and high image quality, and an image forming method using blue light expose for use with the above photothermographic material are provided.

What is claimed is:

1. A photothermographic material comprising a support, and an image forming layer provided on at least one side of the support, the image forming layer comprising at least a photosensitive silver halide, a non-photosensitive organic silver salt, a reducing agent and a binder, wherein:

(1) a silver iodide content of the photosensitive silver halide is not less than 40 mole %;

(2) the binder comprises a hydrophilic binder;

(3) the image forming layer comprises a silver iodide complexing agent; and (4) the image forming layer comprises, as a silver carrier, at least one compound represented by the following Formula (I) or (II):

Formula (I)

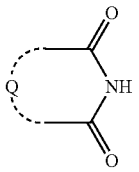

(wherein Q represents an atomic group that is necessary to form a 5 or 6-membered imide ring);

Formula (II)

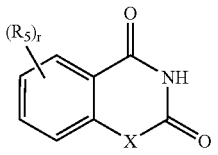

(wherein: $R_5$ independently represents a hydrogen atom, alkyl group, cycloalkyl group, alkoxy group, alkylthio group, arylthio group, hydroxyl group, halogen atom or $N(R_8R_9)$, where $R_8$ and $R_9$ each independently represents a hydrogen atom, alkyl group, aryl group, cycloalkyl group, alkenyl group or heterocyclic group; r represents 0, 1 or 2; $R_8$ and $R_9$ may be bonded to each other to form a substituted or unsubstituted 5 to 7-membered hetero ring; two groups represented by $R_5$ may be linked together to form an aromatic, heteroaromatic, alicyclic or heterocyclic condensed ring; and X represents O, S, Se or $N(R_6)$, where $R_6$ represents a hydrogen atom, alkyl group, aryl group, cycloalkyl group, alkenyl group or heterocyclic group).

2. A photothermographic material according to claim 1, wherein the silver iodide content is not less than 80 mole %.

3. A photothermographic material according to claim 2, wherein the silver iodide content is not less than 90 mole %.

4. A photothermographic material according to claim 3, wherein the silver iodide content is not less than 95 mole %.

5. A photothermographic material according to claim 1, wherein the image forming layer comprises at least one selected from polyacrylamides and derivatives thereof.

6. A photothermographic material according to claim 5, comprising a non-photosensitive organic silver salt formed into grains in the presence of the at least one selected from polyacrylamides and derivatives thereof.

7. A photothermographic material according to claim 1, wherein the non-photosensitive organic silver salt comprises nano-grains.

8. A photothermographic material according to claim 7, wherein a mean grain size of the nano-grains is in a range from 10 nm to 1000 nm.

9. A photothermographic material according to claim 1, wherein the reducing agent comprises a compound represented by the following Formula (R):

Formula (R)

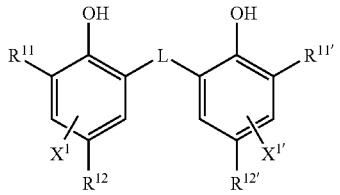

(wherein: $R^{11}$ and $R^{11'}$ each independently represents an alkyl group, where at least one of $R^{11}$ and $R^{11'}$ is a secondary or tertiary alkyl group; $R^{12}$ and $R^{12'}$ each independently represents a hydrogen atom or a substituent that is substitutable on a benzene ring; L represents —S— or —$CHR^{13}$—, where $R^{13}$ represents a hydrogen atom or an alkyl group; and $X^1$ and $X^{1'}$ each independently represents a hydrogen atom or a substituent that is substitutable on a benzene ring).

10. A photothermographic material according to claim 9, wherein the hydrophilic binder comprises gelatin or a gelatin derivative.

11. A photothermographic material according to claim 10, wherein a ratio by mass of the non-photosensitive organic silver salt to the binder in the image forming layer is in a range from 1.0 to 2.5.

12. An image forming method, wherein the photothermographic material according to claim 1 is exposed to light having a wavelength in a range from 350 nm to 450 nm.

13. An image forming method according to claim 12, wherein the light having a wavelength in a range from 350 nm to 450 nm comprises laser light.

14. An image forming method according to claim 13, wherein the laser light comprises light emitted from a semiconductor laser.

15. An image forming method according to claim 14, wherein the semiconductor laser comprises a blue semiconductor laser.

16. An image forming method according to claim 12, wherein the photothermographic material is thermally developed at a linear velocity of not less than 23 mm/second.

* * * * *